US005697030A

United States Patent [19]

Hayashi et al.

[11] Patent Number: 5,697,030

[45] Date of Patent: Dec. 9, 1997

[54] IMAGE FORMING APPARATUS WITH TRANSFER BELT PRESSING MEMBER

[75] Inventors: Yukio Hayashi; Norio Hokari; Shuji Iseki; Ryoichi Tsuruoka; Mikio Kobayashi; Junichirou Sameshima, all of Ebina, Japan

[73] Assignee: Fuji Xerox Co., Ltd., Tokyo, Japan

[21] Appl. No.: 728,782

[22] Filed: Oct. 10, 1996

[30] Foreign Application Priority Data

Oct. 13, 1995 [JP] Japan ..... HEI-7-265991
Sep. 3, 1996 [JP] Japan ..... HEI-8-233138

[51] Int. Cl.[6] ..... G03G 15/16

[52] U.S. Cl. ..... 399/299; 399/312

[58] Field of Search ..... 399/299, 303, 399/304, 312, 316, 318

[56] References Cited

U.S. PATENT DOCUMENTS 5,455,663 10/1995 Inoue et al. ..... 399/303

FOREIGN PATENT DOCUMENTS 3-87876 4/1991 Japan .

*Primary Examiner*—Joan H. Pendegrass
*Attorney, Agent, or Firm*—Oliff & Berridge

[57] ABSTRACT

An image forming apparatus comprising:

an endless belt that is wrapped around and so transported by a plurality of rollers;

rotating members which are disposed adjacent to the endless belt such that an image is transferred onto a sheet while the sheet passes between the rotating members and the endless belt;

pressing means that are disposed in a crosswise direction of the endless belt so as to be opposite to the rotating members with respect to the endless belt and press the endless belt against the rotating member in the vicinity of the position where the endless belt is in close proximity to the rotating member; and edge reinforcing means for increasing pressing forces of the pressing means that act on both edges of the endless belt in the crosswise direction thereof so as to become greater than a pressing force of the pressing means that acts on the center of the endless belt in the same direction.

12 Claims, 10 Drawing Sheets

IMAGE FORMING APPARATUS WITH TRANSFER BELT PRESSING MEMBER

BACKGROUND OF THE INVENTION

The present invention relates to an image forming apparatus such as a copier, a printer, or a facsimile.

In an image forming apparatus, a visible image is formed on the surface of an image carrier such as a photosensitive drum using a toner. The thus-formed visible image is transferred onto a sheet such as copying paper, and that image is then fixed on the sheet by means of heat or pressure. One example of an image transfer apparatus is arranged so as to operate in the following way. Specifically, the sheet is held on a film of a transfer drum that travels while remaining in contact with the image carrier, or the sheet is held on the surface of a transfer belt, which is formed from a film in the shape of an endless belt, by electrostatic absorption. The sheet is carried to the image carrier. By the action of an electric field generated by a transfer corotron that is disposed so as to be opposite to the image carrier with the film interposed between them, a toner is transferred onto the sheet held on the film. Taking the transfer belt as an example, the image transfer apparatus will be described hereinbelow.

To improve a picture quality as well as a transfer efficiency, it is desirable to bring the sheet into close contact with the image carrier and to ensure the length of a contact area to a certain degree of extent. To this end, it is common practice to bring a pressing member into pressed contact with the transfer belt at the position in an upstream direction with respect to the optimum image transfer position. The transfer belt is pressed against the image carrier by the pressing member, which in turn brings the sheet into pressed contact with the image carrier.

The pressing member is disposed upstream in the direction of travel of the transfer belt with respect to the position where the visible image is to be transferred. As a result, the pressing member doubles as means for shielding the transfer belt upstream of the image transfer position from the electric field produced by the transfer corotron. With this arrangement, a phenomenon called gap transfer is prevented. The gap transfer means the adherence of a small amount of toner to the position slightly deviated from a desired position on the sheet as a result of the transfer of the toner to the sheet from the image carrier before the sheet comes into contact with the image carrier.

For example, the Unexamined Japanese Patent Application No. Hei. 3-87876 discloses a technique of pressing a film on the surface of the transfer drum against a photosensitive drum using such a pressing member as previously described. A pressing force is evenly afforded to the entire transfer drum in the crosswise direction thereof by the pressing member. The sheet is evenly pressed by and large between the transfer drum and the photosensitive drum.

However, such a technique presents the following problems. In recent years, an image forming apparatus having the function of forming an image on each side of one sheet of paper has achieved widespread use. In this type of image forming apparatus, after an image has been formed on one side of the sheet, the sheet passes through a fixing unit in order to fix the image. Subsequently, an image is transferred and fixed on the other side of the sheet. In terms of the property of components of the currently dominant toner, a common fixing unit is designed so as to press and heat the sheet. The sheet is usually carried, heated, and pressurized by causing the sheet to pass between a heating roller and a pressurizing roller. If the sheet passes between the pressing roller and the pressurizing roller, the sheet will become crumple up (or wavy) particularly where the sheet is paper. Both edges of the sheet in the crosswise direction thereof (i.e., in the direction orthogonal to the direction in which the sheet is transferred) become noticeably crumpled up. The crumples of both edges of the sheet still remain even when the sheet is again attracted by the transfer belt in order to form an image on the other side of the sheet. Even if an attempt is made to press the transfer drum and the transfer sheet against the photosensitive drum by means of an even pressing force applied to the overall sheet in the crosswise direction thereof using the pressing member, the both edges of the sheet will not properly come into close contact with the photosensitive drum. For this reason, when an image is transferred to the sheet from the photosensitive drum, imperfections in an image such as slight positional displacements of the image or partial omission of a transferred image become more apt to arise.

Particularly in the case of a transfer belt which is formed from a film in the shape of an endless belt, side edges of the transfer drum that are not supported by the roller become deflected under its own weight in contrast to the transfer drum. For this reason, even if an even pressing force is applied to the overall sheet in the crosswise direction thereof by means of the pressing member, it is difficult to make the crumpled-up side edges of the transfer belt smooth.

Simple application of a large pressing force to the overall sheet hinders the transfer of a toner, which in turn results in image failures so-called hollow characters.

If thin paper is used as a transfer material, significantly noticeable image failures will arise. Further, even if an image is formed on the surface of standard paper in hot and humid surroundings, or if a high-density image is formed on the standard surface, image failures will also arise.

SUMMARY OF THE INVENTION

The present invention has been conceived in consideration of the foregoing problems in the art, and the primary object of the present invention is to provide an image forming apparatus capable of properly transferring an image to a sheet having both edges crumpled up as occurring when an image is formed on each side of the sheet.

To solve the above-described problems, the present invention provides an image forming apparatus comprising:

- an endless belt that is wrapped around and so transported by a plurality of rollers;
- rotating members which are disposed adjacent to the endless belt such that an image is transferred onto a sheet while the sheet passes between the rotating members and the endless belt;
- pressing means that are disposed in a crosswise direction of the endless belt so as to be opposite to the rotating member with the endless belt interposed between them and press the endless belt against the rotating member in the vicinity of the position where the endless belt is in close proximity to the rotating member; and
- edge reinforcing means for increasing pressing forces of the pressing means exerted on both edges of the endless belt in the crosswise direction thereof so as to become greater than a pressing force of the pressing means exerted on the center position of the endless belt in the same direction.

As described above, the pressing forces of the pressing means exerted on both edges of the endless belt in the crosswise direction thereof is increased so as to be greater than the pressing force of the pressing means exerted on the center of the endless belt in the same direction by use of the edge reinforcing means. In consequence, the pressing means can appropriately press both edges of the sheet against the rotating members by the pressing means even when the sheet has both edges crumpled up, which makes it possible to improve the quality of a resultantly formed image.

If the area of the endless belt that faces the sheet is displaced from the center of the endless belt in the crosswise direction thereof, the edge reinforcing means preferably increases the pressing force of the pressing means disposed in the area of a larger interval between the side edge of the endless belt and the side edge of the area so as to become greater than the pressing force of the pressing means disposed in the area of a smaller interval between the side edge of the endless belt and the side edge of the coverage area.

If an image is formed on each side of the sheet by passing one sheet between the endless belt and the rotating members twice, the edge reinforcing means is arranged so as to be able to change the reinforcing strength applied to the pressing means. The image forming apparatus should preferably be provided with control means for increasing the reinforcing strength applied from the edge reinforcing means to the pressing means before another image is formed after one image has been formed on one surface of the sheet.

In most cases, both edges of the sheet become crumpled up when the sheet passed through the fixing unit in order to fix the image transferred to the sheet. Consequently, the reinforcing strength exerted on the pressing means from the edge reinforcing means are not necessary when an image is formed on one surface of the sheet. It is only necessary for the control means to increase the reinforcing strength applied from the edge reinforcing means to the pressing means using, e.g., a solenoid, cam, or link, before another image is formed on the other surface after the image has been formed on one surface of the sheet.

It is also desirable to provide the image forming apparatus with fixing means for fixing the image transferred to the sheet by heating and pressurizing the sheet, and temperature detecting means for detecting the temperature of the fixing means. The control means should preferably determine whether or not the reinforcing strength applied from the edge reinforcing means to the pressing means is increased, from the result detected by the temperature detecting means.

There is a close relationship between the crumpling up of both edges of the sheet in the crosswise direction thereof and the temperature of the fixing unit. Since whether or not the sheet becomes crumpled up arise is predicted from the temperature of the fixing means, the control means should preferably increase the reinforcing strength applied to the pressing means from the edge reinforcing means when crumples are predicted.

Alternatively, the image forming apparatus is preferably provided with image density measuring means for measuring the density of the image transferred to the sheet. It is also possible for the control means to determine whether or not the reinforcing means applied to the pressing means from the edge reinforcing means is increased, from the result of the measurement carried out by the image density measuring means.

There is also a close relationship between the crumpling up of both edges of the sheet in the crosswise direction thereof and the density of an image formed on the sheet. For this reason, it is predicted from the density of an image whether or not crumples arise in the edges of the sheet. Hence, it is preferable to increase the reinforcing strength applied to the pressing means from the edge reinforcing means when crumples are predicted.

In another aspect of the present invention, there is provided an image forming apparatus including a toner image carrier that carries a toner image, transfer means that is disposed so as to be opposite to the toner image carrier and forms an electric field for transfer purposes between the transfer means and the toner image carrier, a transfer belt that is rotatable so as to pass between the toner image carrier and the transfer means and attracts a transfer material, pressing means that are disposed upstream of the transfer means in the direction of rotation of the transfer belt and press the transfer belt against the toner image carrier, and fixing means that is disposed downstream of the transfer belt in the direction of a transport path of the transfer material and heats and/or pressurizes the transfer material peeled from the transfer belt. The toner image is transferred to the transfer material while the transfer material is attracted to the transfer belt. An image is formed on the transfer material by heating and/or pressuring the transfer material using the fixing means. An image can be formed on both surfaces of the transfer material by repetitively carrying out the above-described processes. The image forming apparatus is characterized by the fact that the pressing means are formed such that the pressing forces exerted on both edges of the transfer belt in the crosswise direction thereof become greater than the pressing force exerted on the center of the transfer belt in the crosswise direction thereof. The pressing means are also provided with a center pressing force reinforcing member that reinforces the pressing force of the center of the pressing means when being brought into pressed contact with the pressing means, and center pressing force reinforcing member control means that controls the state in which the center pressing force reinforcing member is pressed against the pressing means and presses the center pressing force reinforcing member against the pressing means as necessary when forming an image on the back of the transfer material.

In the above described image forming apparatus of the present invention, the toner image carrier may be anything capable of carrying a toner image. For instance, an image carrier such as a photosensitive drum on which a toner image is formed or an intermediate transfer member to which a toner image is transferred from the image carrier, may be mentioned as the toner image carrier.

The transfer means may be anything that can be disposed so as to be opposite to the toner image carrier and is capable of forming an electric field for transfer purposes between the toner image carrier and the transfer means. For instance, a transfer corotron that is opposite to as well as being spaced apart from the toner image carrier may be mentioned as the transfer means.

The transfer belt may be anything which rotates so as to pass between the toner image carrier and the transfer means and is capable of attracting the transfer material. For example, an endless belt may be mentioned which is made by forming a film consisting of resin materials possessing high electrical insulating properties, e.g., polyethylene terephthalate (PET), polyvinylidene fluoride (PVDF), polyester, polycarbonate, or polyether-ether-ketone, into a strip, and by welding both ends of that strip together by application of, e.g., ultrasonic. The transfer belt is wrapped around a plurality of rollers. With this exemplary configuration, it is possible to rotate the transfer belt by rotating the rollers. One example of the method of causing the transfer belt to attract the transfer material is a method of electrostatically charging the transfer belt and the transfer material such that they have opposite polarities by means of a pair of electrostatic rollers that are disposed with the transfer belt interposed between them, and causing the transfer belt to attract the transfer material by virtue of an electrostatic attracting force.

The fixing means may be anything that is disposed downstream of the transfer belt in the direction in which the transfer material is transported and is capable of heating and/or pressurizing the transfer material peeled from the transfer belt. For example, the fixing means may be made up of a pair of fixing rollers that are disposed adjacent to and downstream of the transfer belt in the direction in which the transfer material is transported as well as being capable of heating and pressurizing the transfer material peeled from the transfer belt.

The pressing means are anything that are disposed upstream of the transfer means in the direction in which the transfer belt rotates and are capable of pressing the transfer belt against the toner image carrier such that the pressing forces exerted on both edges of transfer belt in the crosswise direction become greater than the pressing force exerted on the center of the transfer belt. For instance, the pressing means may be made up of baffles disposed upstream of the transfer means in the direction in which the transfer belt rotates, and edge pressing force reinforcing members for reinforcing the pressing forces which act on both edges of the baffle. A thin plate that has high electrical insulating properties, e.g., Mylar or polyethylene terephthalate (PET), and is rectangularly formed into convenient sizes may be used as the baffles or the edge pressing force reinforcing members. Although the pressing means may be fixedly arranged so as to constantly press the transfer belt, they may be arranged in a movable (pivotal) manner so as to press the transfer belt only when an image is formed.

The center pressing force reinforcing member may be anything that reinforces the center pressing force of the pressing means when being pressed against the pressing means. For example, a thin plate that has high electrical insulating properties, e.g., Mylar or polyethylene terephthalate (PET), and is formed into such a shape as to press the pressing means between its both edges on which the pressing forces of the edge pressing force reinforcing members act.

The center pressing force reinforcing member control means may be anything that controls the state in which the center pressing force reinforcing member is pressed against the pressing means and presses the center pressing force reinforcing member against the pressing means as necessary when an image is formed on the back of the transfer material. For instance, the center pressing force reinforcing member control means may be made up of an electromagnetic solenoid which retains the center pressing force reinforcing member so as to bring it into contact with, or separate it from, the pressing means, and a press timing control member for controlling the action of the electromagnetic solenoid. Further, a torque transmission mechanism using a cam or various link mechanisms may be used in lieu of the electromagnetic solenoid.

The pressing of the center pressing force reinforcing member against the pressing means signifies the state in which the pressing force of the center pressing force reinforcing member acts on the pressing means.

The pressing of the center pressing force reinforcing member against the pressing means at the time of formation of an image on the back of the transfer material does not signify the limitation of the time period over which the center pressing force reinforcing member is pressed against the pressing means to the time period over which an image is formed on the back of the transfer material; but at least signifies that it is only necessary to press the center pressing force reinforcing member against the pressing means for the period during which an image is formed on the back of the transfer material. Therefore, it is not necessary to press the center pressing force reinforcing member against the pressing means when an image is formed on the front of the transfer material. However, no problems will arise even if the center pressing force reinforcing member is pressed against the pressing means.

Further, the pressing of the center pressing force reinforcing member against the pressing means at the time of formation of an image on the back of the transfer material not only simply signifies the case where the center pressing force reinforcing member is continuously pressed against the pressing means for the time period during which an image is formed on the back of the transfer material; but also signifies that the center pressing force reinforcing member is pressed against the pressing means only for the time period during which an image is transferred to the rear edge portion of the back of the transfer material. The former case is suitable for use with, e.g., common paper, whereas the latter case is suitable for use with, e.g., thin paper.

The pressing of the center pressing force reinforcing member against the pressing means as necessary at the time of formation of an image on the back of the transfer material signifies that the center pressing force reinforcing member is not always pressed against the pressing means when an image is transferred to the back of the transfer material as well as that the center pressing force reinforcing member is always pressed against the pressing means when an image is transferred to the back of the transfer material. The center pressing force reinforcing member is not always pressed against the pressing means in the case: for example, where the pressing action is carried out depending on the type of transfer material (e.g., the center pressing force reinforcing member is pressed against the pressing means where the transfer material is thin); where the pressing action is carried out depending on the moisture content of the transfer material (e.g., the center pressing force reinforcing member is pressed against the pressing means where the transfer material has a high moisture content); or where the pressing action is carried out depending on the density of the image formed on the front of the transfer material (e.g., the center pressing force reinforcing member is pressed against the pressing means where the density of the image is high).

A method of identifying the type of transfer material by a tray in which the transfer material is stored or a method of causing an operator to select a mode (e.g., thick paper, ordinary paper, etc.) from a control panel, may be mentioned as the method for identifying the type of transfer material. A method of estimating a moisture content from the result of the measurement carried out by an internal environment measuring member (e.g., a temperature sensor) for measuring the environment of the image forming apparatus, or a method of estimating a moisture content from the result of measurement of an electrical current flowing between the pair of electrostatic rollers for causing the transfer belt to attract the transfer material, may be mentioned as the method of measuring the moisture content of the transfer material. The internal environment measuring member should be disposed as much close to the center of the image forming apparatus as possible. If the internal environment is disposed as much close to the periphery of the tray as possible, the correspondence between the measurement results and the moisture content of the transfer material will be improved. A method of estimating the density of an image from the result of the measurement carried out by a density sensor (e.g., an optical sensor) that is disposed so as to be opposite to the path along which the transfer material is transported, or a method of estimating the density of an image from the image information to be used in forming a toner image, may be mentioned as the method of measuring the density of an image formed on the front of the transfer material.

In the image forming apparatus of the present invention, the pressing means are formed such that the pressing forces exerted on both edges of the transfer belt in the crosswise direction thereof become greater than the pressing force exerted on the center of the transfer belt in the crosswise direction thereof. The pressing means are provided with the center pressing force reinforcing member that reinforces the pressing force of the center of the pressing means when being brought into pressed contact with the pressing means, and the center pressing force reinforcing member control means that controls the state in which the center pressing force reinforcing member is pressed against the pressing means and presses the center pressing force reinforcing member against the pressing means as necessary when forming an image on the back of the transfer material. When a toner image is transferred to the back of the transfer material, the state in which the toner image carrier is pressed against the transfer material (i.e., the transfer belt) can be switched between the state in which the pressing forces exerted on both edges of the transfer belt become greater than the pressing force exerted on the center of the transfer belt in the crosswise direction thereof and the state in which the pressing force exerted on the center of the transfer belt is increased greater than in the previously-described state; namely, the state in which the pressing force exerted on the center of the transfer belt in the transfer direction thereof is smaller than the pressing forces exerted on both edges of the transfer belt in the same direction, as required.

For these reasons, where images are formed on each side of the transfer material, e.g., standard paper-in the above-described image forming apparatus, the state in which the toner image carrier is pressed against the transfer material (i.e., the transfer belt) is set such that the pressing forces exerted on both edges of the transfer belt in the crosswise direction thereof become greater than the pressing force exerted on the center of the transfer belt in the same direction. As a result, the toner image can be transferred to the back of the transfer material, which in turn makes it possible to prevent imperfections in picture quality resulting from partial omission of a transferred image.

In the above-described image forming apparatus, where images are formed on each side of the transfer material, e.g., thin paper in the above-described image forming apparatus, the state in which the toner image carrier is pressed against the transfer material (i.e., the transfer belt) is set such that the pressing forces exerted on the center of the transfer belt in the crosswise direction thereof becomes greater than in the case where the standard paper is used. As a result, a toner image can be transferred on the back of the transfer material, which in turn makes it possible to prevent imperfections in picture quality resulting from partial omission of a transferred image.

The balance between the pressing forces arising when the center pressing force reinforcing member is pressed against the pressing means differs depending on the setting of the image forming apparatus. In other words, no problems arise in any one of the cases: where the pressing forces exerted on both edges of the transfer belt in the crosswise direction thereof become greater than the pressing force exerted on the center of the transfer belt in the same direction; where an even pressing force act on the transfer belt in the crosswise direction thereof; and where the pressing force exerted on the center of the transfer belt in the crosswise direction thereof becomes greater than the pressing forces exerted on both edges of the transfer belt in the same direction. All that needs to be done is to set the pressing forces in such an extent as to prevent imperfections in picture quality, e.g., so-called hollow characters like omission of colors from the middle of a fine line art as a result of a toner image being flattened.

BRIEF DESCRIPTION OF THE DRAWINGS

FIG. 12 is a plot that shows variations in the temperature of the fixing unit with lapse of time after the power switch of the image forming apparatus has been turned on;

DETAILED DESCRIPTION OF THE PREFERRED EMBODIMENTS

With reference to the accompanying drawings, preferred embodiments of the present invention will now be described.

(1) First Embodiment

A. Configuration of an Image Forming Apparatus of the First Embodiment

Figure 1:
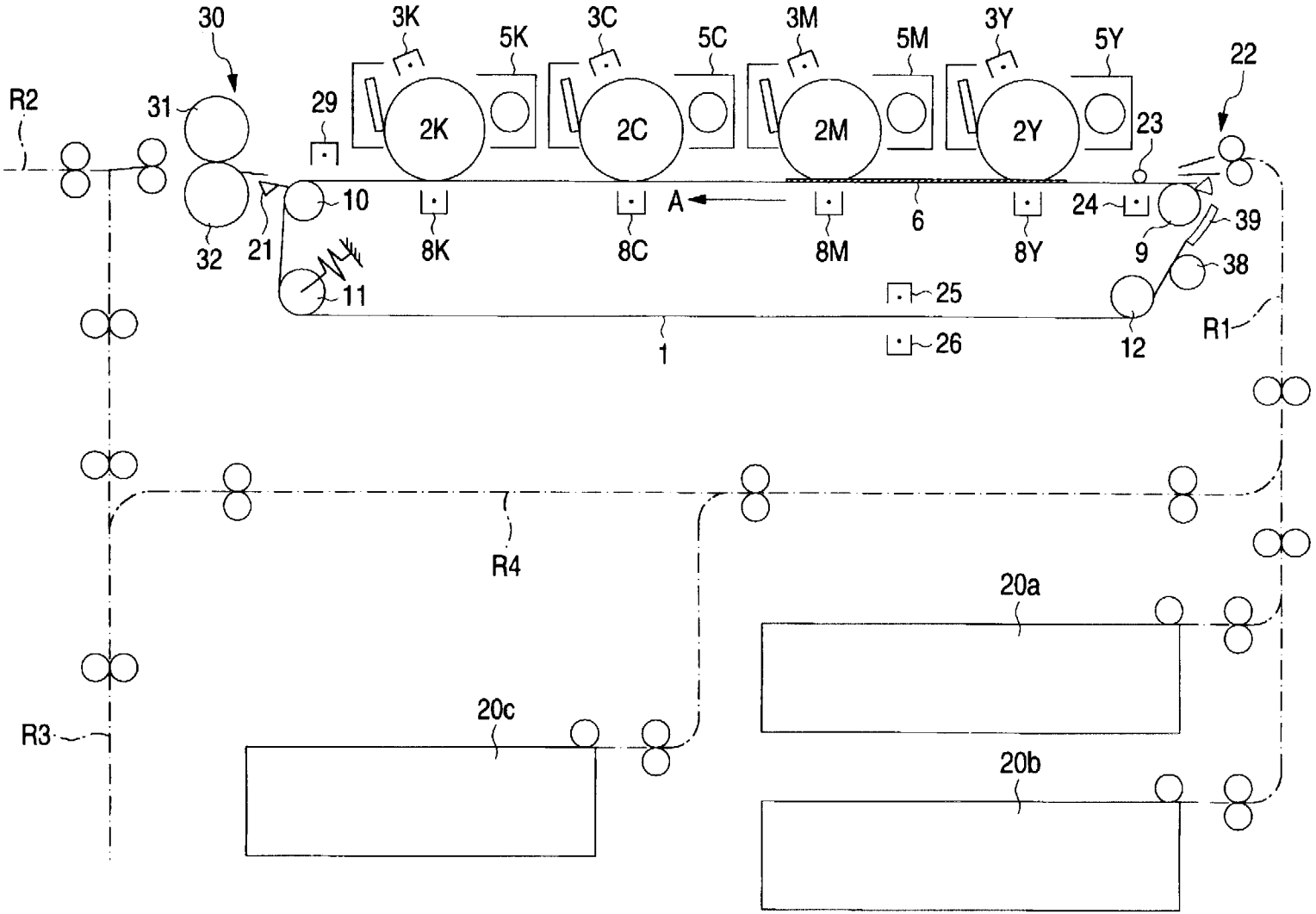
FIG. 1 is a schematic representation of an image forming apparatus according to one embodiment of the present invention.

A-1. Overall Configuration of the Image Forming Apparatus of the First Embodiment FIG. 1 is a schematic representation of an image forming apparatus according to a first embodiment of the present invention. This image forming apparatus is a so-called tandem full-color image forming apparatus. In the drawing, reference numeral 1 designates a transfer belt (an endless belt). This transfer belt 1 is wrapped around a drive roller 9, a tension application roller 11, and idler rollers 10 and 12. The transfer belt 1 is rotatable along a substantially rectangular and oblong track in a counterclockwise direction in the drawing as designated by the arrow A. The transfer belt 1 travels along the rollers 9 to 12 while being driven by the drive roller 9 as well as receiving a tension from the tension application roller 11.

Photosensitive drums (rotating members) 2 (2Y, 2M, 2C, and 2K) are rotatably disposed above the transfer belt 1. Corotrons 3Y, 3M, 3C, and 3K for electrostatic charging purposes, unillustrated apparatuses for writing a latent image to the photosensitive drums, and developing units 5Y, 5M, 5C, and 5K are disposed around the photosensitive drums 2Y, 2M, 2C, and 2K. The surfaces of the photosensitive drums 2Y, 2M, 2C, and 2K are evenly charged to a voltage of, e.g., −500 through −800, by the electrostatically charging corotrons 3Y, 3M, 3C, and 3K. The latent image writing apparatuses form latent images by exposing the electrostatically charged photosensitive drums 2Y, 2M, 2C, and 2K to laser beams on the basis of write instruction signals that are made by separating the image according to colors. The developing units 5Y, 5M, 5C, and 5K cause toners to adhere to the latent images, so that the latent images become visible. The developing units 5Y, 5M, 5C, and 5K feed yellow, magenta, cyan, and black toners to the photosensitive drums 2Y, 2M, 2C, and 2K. The toners become charged with negative polarity that is the same as the polarity of the electrostatically charged photosensitive drums 2Y, 2M, 2C, and 2K. As a result, the toners adhere to the photosensitive drums 2Y, 2M, 2C, and 2K by virtue of a so-called reversal processing effect.

The transfer belt 1 is arranged so as to travel while maintaining contact with the photosensitive drums 2Y, 2M, 2C, and 2K, as well as being driven by the drive roller 9. A sheet 6 is attracted to the surface of the transfer belt 1. The sheet 6 comes into contact with the photosensitive drums 2Y, 2M, 2C, and 2K one another as the transfer belt 1 travels. The sheet 6 is selected from any one of paper feed trays 20, 21, and 22, and the thus-selected sheet is transported by conveyor rollers. The sheet 6 passes along a feed route R1 and is fed to the transfer belt 1. On entering the transfer belt 1, the sheet 6 is positioned by a registration gate 22 and remains in a standby condition up to predetermined timing. Upon release from the registration gate 22, the sheet 6 is electrostatically attracted to the transfer belt 1 by virtue of an electric field of a corotron 24 for attracting purposes, as well as being pressed against the transfer belt 1 by a pressing roller 23.

Transfer corotrons (transfer means) 8 (BY, 8M, 8C, and 8K) are disposed so as to be opposite to the photosensitive drums 2Y, 2M, 2C, and 2K with the transfer belt 1 sandwiched between them. A positive voltage is applied to the transfer corotrons BY, 8M, 8C, and 8K. By action of an electric field resulting from corona discharge caused by the transfer corotrons, the negatively charged toners on the photosensitive drums 2Y, 2M, 2C, and 2K are transferred to the sheet 6 on the transfer belt 1. In this way, yellow, magenta, cyan, and black toners are transferred onto the sheet 6 each time the sheet 6 passes through the nipping areas formed between the photosensitive drums 2Y, 2M, 2C, and 2K and the transfer belt 1.

The sheet 6 on which the multicolor toners are transferred reaches a corotron 29 for use in removing the sheet as the travel of the transfer belt 1. The force that causes the transfer belt 1 to attract the sheet 6 is reduced by the corotron 29, and the sheet 6 is peeled from the transfer belt 1. The toners are fixed to the sheet 6 while the sheet 6 passes between a heating roller 31 and a pressurizing roller 32 of a fixing apparatus (fixing means) 30. Further, the toners are subjected to color development in various colors, as well as being fused on the sheet 6 upon receipt of heat and pressure while the sheet 6 passes between the heating roller and the pressurizing roller. In this way, an image is fixed on the sheet 6. The heating roller 31 has a built-in lamp (not shown), and this built-in lamp heats the heating roller 31.

The sheet 6 passed through the fixing apparatus 30 is discharged through a discharge route R2. Where another image is formed on the back of the sheet 6 having the image formed thereon, the sheet 6 is introduced to an inversion route R3 for double-sided copying purposes and further to a transport route R4 for double-sided copying purposes. As a result, the sheet 6 is fed to the feed route R1 again.

In contrast, the transfer belt 1 is subjected to the removal of static electricity carried out by corotrons 25 and 26 for removing static electricity from the belt. The transfer belt 1 is further cleaned by a cleaning roller 38 and a cleaning blade 39. The transfer belt 1 transfers the sheet 6 fed through the registration gate 22.

A-2. Transfer Belt

Figure 2:
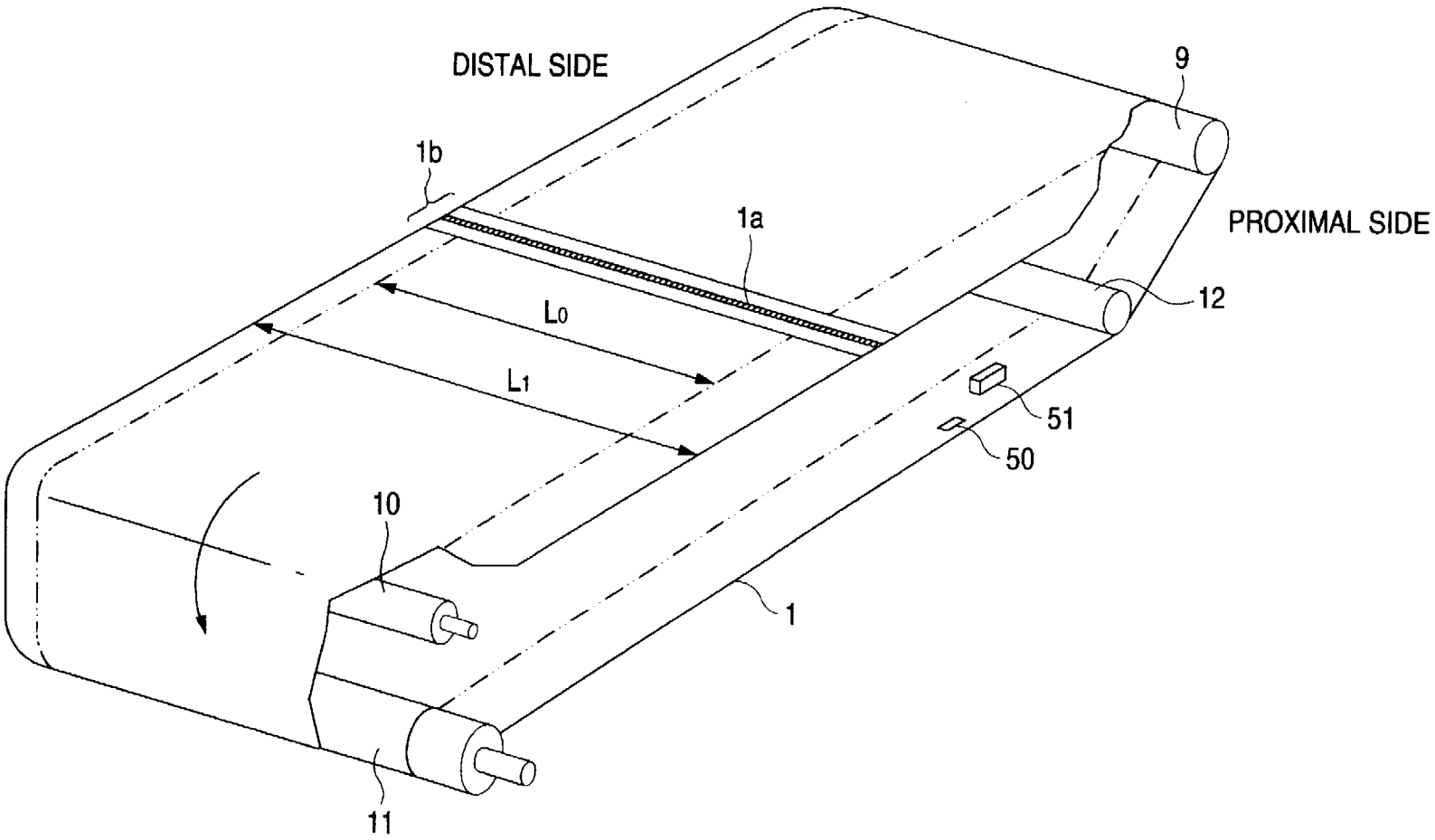
FIG. 2 is a perspective view of a transfer belt of the embodiment.

FIG. 2 shows the transfer belt 1 and the rollers 9 through 12 that support the transfer belt 1. The transfer belt 1 is made by forming a film consisting of resin materials possessing high electrical insulating properties, e.g., polyethylene terephthalate (PET), polyvinylidene fluoride (PVDF), polyester, polycarbonate, or polyether-ether-ketone, into a strip, and by welding both ends of that strip together by application of, e.g., ultrasonic. In the drawing, reference numeral 1*a* designates a welded seam. Image formation forbidden areas 1*b* extending along both sides of the seam 1*a* have a rough surface and an uneven thickness. For this reason, the image formation forbidden areas 1*b* are arranged so as not to attract the sheet 6.

A rectangular belt hole 50 is formed in the transfer belt 1 in order to indirectly detect the seam 1*a*. A belt hole sensor 51 for detecting the belt hole 50 is fixedly disposed so as to become spaced apart from the transfer belt 1. A photosensor comprising a light-emitting element and a light-receiving element is used as the belt hole sensor 51. The belt hole sensor 51 detects the belt hole 50 by means of the intensity of the light reflected from the inner peripheral surface of the transfer belt 1.

The belt hole 50 is formed along one side edge of the transfer belt (e.g., the proximal side edge of the image forming apparatus). Because of this, a sheet attracting area on the transfer belt 1 is set so as to deviate from the center of the transfer belt 1 in a crosswise direction thereof, as designated by a phantom line in the drawing. The area that is defined along the proximal side edge of the transfer belt so as not to attract the sheet is set so as to become wider than the area that is defined along the distal side edge of the same so as not to attract the sheet. In the drawing, the width of the transfer belt 1 is designated by $L_0$, and the width of the sheet attracting area on the transfer belt 1 is designated by $L_1$.)

Figure 3:
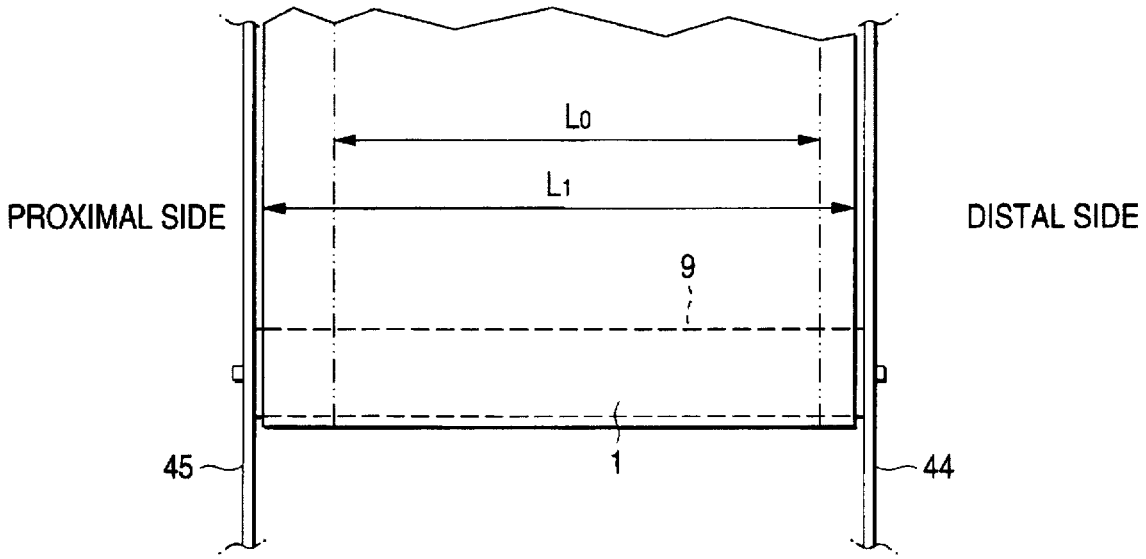
FIG. 3 is a front view of the transfer belt of the embodiment.
Figure 4:
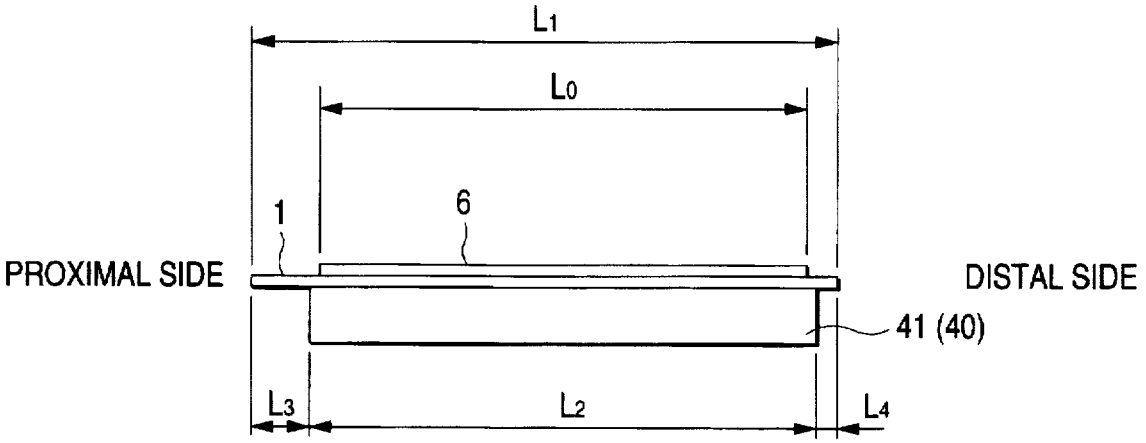
FIG. 4 is a front view of the transfer belt of the embodiment.

FIG. 3 is a plan view of the transfer belt 1, and FIG. 4 is a front view of the same. In these drawings, the width $L_1$ of the transfer belt 1 and the width $L_0$ of the sheet attracting area on the transfer belt 1 are also illustrated. In FIG. 3, reference numerals 44 and 45 designate frames for supporting the rollers 9, 10, 11, and 12. A drive mechanism of the drive roller 9 is omitted from the drawing.

A-3. Pressing Member

Two pressing members (pressing means) 40 and 41 are disposed in the vicinity of each of the transfer corotrons 8; namely, they are disposed so as to be opposite to the photosensitive drums 2 with the transfer belt 1 interposed between them. The pressing members 40 and 41 are formed from a resilient thin plate and are supported on a support 14*a* of a metal support table 14. In short, the pressing member 40 is bonded onto the support 14*a*, and an intermediate layer 42 is stacked on the pressing member 40. The pressing member 41 is further stacked on the intermediate layer 42. The pressing members and the intermediate layer are bonded together with a pressure sensitive adhesive double coated tape (#500 manufactured by Nitto Denko Co., Ltd.). This tape is omitted from the drawing.

In the present embodiment, the pressing members 40 and 41 and the intermediate layer 42 are made from polyethylene terephthalate (PET). The pressing members 40 and 41 are formed so as to have a width of 305 mm and a thickness of 188 μm. Further, free ends extend from the pressing members 40 and 41 to a length of about 10 mm. The intermediate layer 42 is also made from PET so as to have a width of 305 mm and a thickness of 125 μm. The leading edge of the intermediate layer 42 extends so as to become shorter than the free ends of the pressing members 40 and 41. The pressing members and the intermediate layer provided on the support table 14 are thin members as can be seen from the above descriptions, and the thicknesses of them are illustrated in an exaggerated manner in the drawing.

The support table 14 comprises the flat support 14*a*, a protuberance 14*b* that projects from a lower surface of the support 14*a*, and an actuating section 14*c* that projects from the protuberance 14*b* sidewards. A base 16 that supports the support table 14 comprises a bottom 16*a* and two side portions 16*b* that upwardly stand out from the bottom 16*a*. A shaft 15 passes through the side portions 16*b*. The bottom 16*a* further supports the transfer corotron 8.

The protuberance 14*b* of the support table 14 is pivotal around the shaft 15 provided between the side portions 16*b* of the base 16. The support table 14 is disposed upstream of the transfer corotron 8.

One end of the coil spring 17 is hooked to the support table 14, whereas the other end of the coil spring 17 is hooked to a protuberance 16*c* extending from the base 16. With this arrangement, the support table 14 is forced in a clockwise direction in the drawing, and the leading edges of the pressing members 40 and 41 are pressed against the back of the transfer belt 1. As a result, the pressing members 40 and 41 slightly deflect.

In the image forming apparatus having the previously described arrangement, the position where the transfer of an image is most efficiently carried out, i.e., a so-called transfer point, is the location where a wire 8*b* disposed at the center of the transfer corotron 8 comes closest to the photosensitive drum 2. In short, the transfer point is defined at the intersection between the transfer belt 1 and an imaginary line connecting the radius of the photosensitive drum 2 with the radius of the wire 8*b*. The pressing members 40 and 41 are disposed upstream of the transfer point in the direction in which the transfer belt 1 travels. The leading edges of the pressing members 40 and 41 are in contact with the transfer belt 1 at an upstream position with respect to the transfer point. Of these leading edges, the leading edge of the pressing member 40 in a downstream direction is in contact with the transfer belt 1 at an upstream position in close proximity to the transfer point.

As previously described, the pressing members 40 and 41 are formed from PET having a high volume resistivity. As a result of the above-described arrangement, the pressing member 40 doubles as means for shielding the transfer belt upstream of the transfer point from the electric field produced by the transfer corotron 8. The pressing member 41 doubles as means for assisting the shielding function of the pressing member 40.

FIG. 4 shows the positions of the pressing members 40 and 41. In the drawing, $L_2$ designates the width of the pressing members 40 and 41. As described above, the width $L_2$ of the pressing members 40 and 41 is 305 mm. The width $L_2$ is set so as to become wider than the width $L_0$ of the sheet attracting area in order to press the overall sheet 6 against the photosensitive drum 2. However, the width $L_2$ of the pressing members 40 and 41 are set so as to become narrower than the width $L_1$ of the transfer belt 1.

As a result of provision of the belt hole 50 and the belt hole sensor 51 (see FIG. 2), the sheet attracting area (having the width $L_0$) on the transfer belt 1 is set so as to deviate from the center of the transfer belt 1 (having the width $L_1$) in a crosswise direction thereof. The area that is defined along the proximal side edge of the transfer belt so as not to attract the sheet is set so as to become larger than the area that is defined along the distal side edge of the transfer belt so as not to attract the sheet. For this reason, a distance $L_3$ between the proximal side edge of the transfer belt 1 and the proximal side edges of the pressing members 40 and 41 is set so as to become larger than a distance $L_4$ between the distal side edge of the transfer belt 1 and the distal side edges of the pressing members 40 and 41.

A-4. Edge Reinforcing Member

With reference FIGS. 5 and 6, an edge reinforcing member (edge reinforcing means) 43 of the pressing members 40 and 41 will be described. As shown in these drawings, two side edge reinforcing members 43 are bonded on the pressing member 43 along both side edges thereof. Like the pressing members 40 and 41 and the intermediate layer 42, the side edge reinforcing members 43 are rectangularly formed from PET so as to have a thickness of 250 μm. The entire bottom of each of the edge reinforcing members 43 is bonded to an upper surface of the pressing member 41. These edge reinforcing members are also bonded with the pressure sensitive adhesive double coated tape (#500 manufactured by Nitto Denko Co., Ltd.). This tape is omitted from the drawing.

Figure 5:
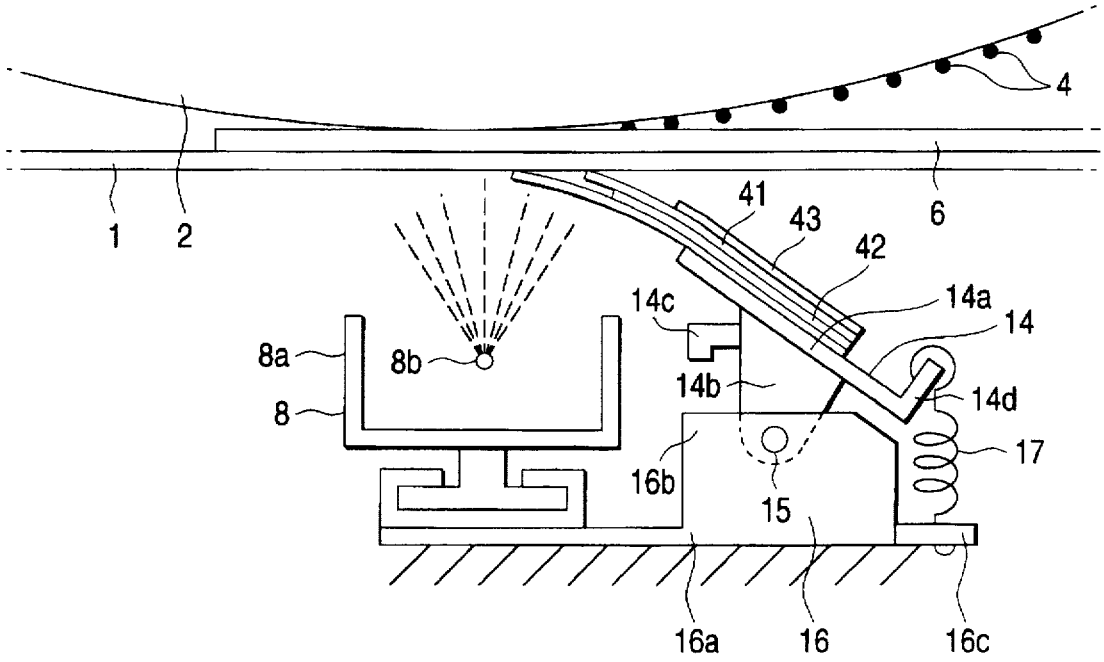
FIG. 5 is a side view of the principal elements of the image forming apparatus of the embodiment.

As shown in FIG. 5, the edge reinforcing members 43 are bonded to the pressing member 41 while their bases are in alignment with the base of the pressing member 41 so as to prevent the leading edges of the reinforcing members 43 from reaching the vicinity of the leading edges of the pressing members 40 and 41, that is, the portions of the pressing members that come into contact with the transfer belt 1. The leading edges of the edge reinforcing members 43 project a few millimeters from the support table 14. As a result of the edge reinforcing members 43 being bonded to the pressing member 41, both sides of the pressing members 40 and 41 have an increased thickness. Therefore, both sides of the pressing members 40 and 41 become less apt to bend compared with the other portions thereof. Even if the pressing members 40 and 41 afford the pressing force to the transfer belt 1 by means of the same coil spring 17, the pressing force afforded to the transfer belt 1 from both sides of the pressing members 40 and 41 become slightly larger than the pressing force afforded to the transfer belt 1 from the center of the pressing members 40 and 41.

Figure 6:
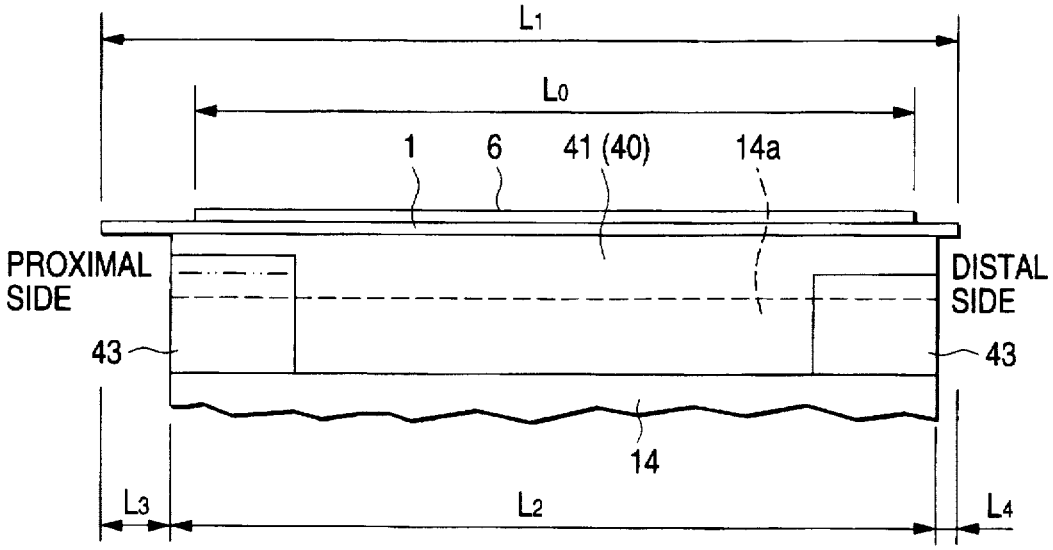
FIG. 6 is a front view of the principal element of the image forming apparatus of the embodiment.

As shown in FIG. 6, the edge reinforcing member 43 provided along the proximal side edge of the pressing member 40 is set so as to become slightly larger than the edge reinforcing member 43 provided along the distal end. Consequently, the proximal side edges of the pressing members 40 and 41 become less apt to bend, whereby the pressing force are slightly increased.

B. Effect of the First Embodiment

Figure 7:
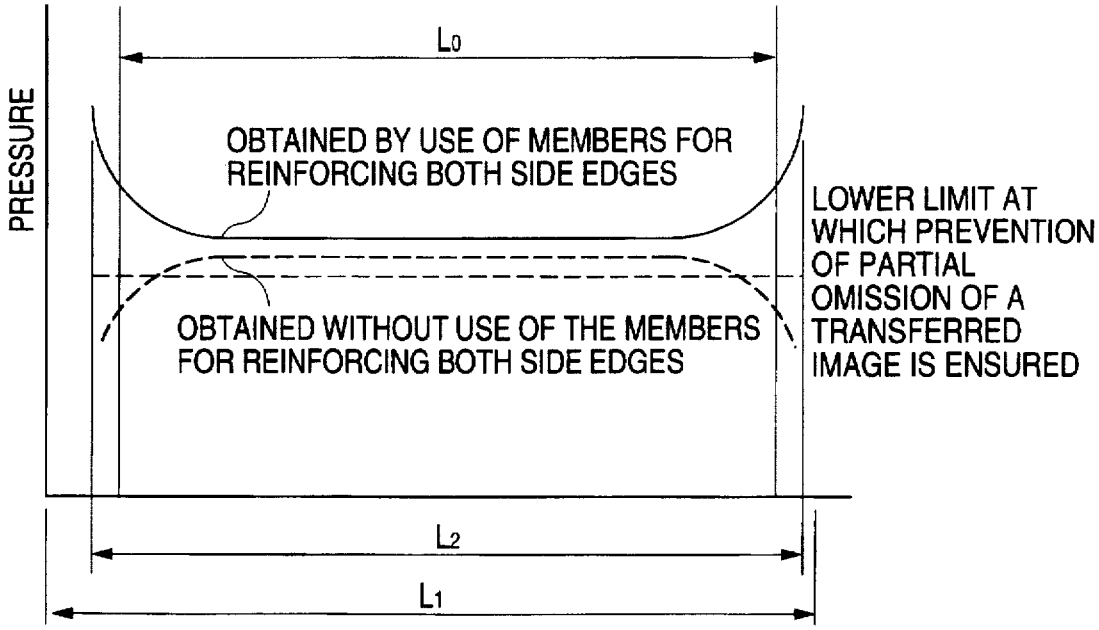
FIG. 7 is a plot showing the distributions of a nipping pressure of the principal elements of the embodiment and a comparative example.

FIG. 7 is a plot showing a reinforcing effect of the edge reinforcing members 43. In the drawing, the vertical axis designates the pressure of the nipping area where the transfer belt 1 comes into contact with the photosensitive drum 2. As shown in the drawing, where the image forming apparatus is provided with the edge reinforcing members 43 as in the present embodiment, the pressing forces that act on both side edges of the transfer belt 1 in the direction of the width L1 are larger than the pressing force that is exerted on the center of the transfer belt 1 in a crosswise direction thereof from the pressing members 40 and 41. This is due to the fact that the pressing forces afforded from both side edges of the pressing members 40 and 41 are set so as to become slightly larger than the pressing force afforded from the center of the pressing members 40 and 41.

The drawing shows the lower pressure limit at which the prevention of partial omission of a transferred image is ensured. The value of this lower pressure limit represents the pressure that prevents the partial omission of a transferred image even if the sheet 6 is crumpled up. The pressing forces that are exerted on both side edges of the transfer belt 1 in the direction of the width L1 from the pressing members 40 and 41 are set so as to become larger than the lower pressure limit. Consequently, even if both side edges of the sheet 6 become crumpled up as a result of passage of the fixing unit 30 in order to form an image on a first plane of the sheet during the course of double-sided printing operations, the side edges can be appropriately brought into pressed contact with the photosensitive drum 2 by means of the pressing members 40 and 41. This makes it possible to improve the quality of resultantly formed images.

As described above, the distance $L_3$ between the proximal side edge of the transfer belt 1 and the proximal side edges of the pressing members 40 and 41 is set so as to become larger than the distance $L_4$ between the distal side edge of the transfer belt 1 and the distal side edges of the pressing members 40 and 41 (see FIG. 6) as a result of provision of the belt hole 50 and the belt hole sensor 51 in the present embodiment. In consequence, the transfer belt 1 is apt to deflect toward the proximal side edge under its own weight, and hence the part of the transfer belt 1 around the proximal side edge is less likely to come into pressed contact with the photosensitive drum 2. In contrast, the edge reinforcing member 43 provided along the proximal side edge of the transfer belt 1 is made slightly wider than the edge reinforcing member 43 provided along the distal side edge in the present embodiment. Further, the pressing force of the pressing members 40 and 41 that act on the proximal side edge of the transfer belt 1 is set so as to become slightly larger than the pressing force that acts on the distal side edge of the same. As a result, substantially even pressing forces act on both side edges of the transfer belt 1, which in turn makes it possible to easily achieve the above-described reinforcing effect. In short, even in the case where the area of the transfer belt 1 that attracts the sheet 6 is deviated from the center of the transfer belt 1 in a crosswise direction thereof, the pressing force exerted on the sheet 6 can be distributed in an appropriate manner. As a result, the quality of an image is improved.

In contrast, if the image forming apparatus is not provided with the edge reinforcing members 43, the pressures exerted on both side edges of the transfer belt 1 in the direction of the width $L_l$ become smaller than the pressure exerted on the center of the transfer belt 1 in a crosswise direction thereof. This is attributable to the fact that the nipping area between the transfer belt 1 and the photosensitive drum 2 is situated at the area of the transfer belt 1 that is not supported by the rollers 9 through 12. In this position, the side edges of the transfer belt 1 deflect under their own weights, and therefore the pressures exerted on both side edges of the transfer belt 1 drop because of the weight. Of the transfer belt 1 even if an even pressing force is afforded to the overall sheet 6 in a crosswise direction thereof by the pressing means 40 and 41. In consequence, even if the pressure exerted on the center of the transfer belt 1 is increased so as to become greater than the lower pressure limit, at which the prevention of partial omission of a transferred image is ensured, by only setting the pressing force of the pressing members 40 and 41 with the coil spring 17, it is difficult to render the crumpled up side edges of the sheet on the transfer belt 1 smooth. Partial omission of a transferred image becomes apt to arise in the areas of the sheet around the side edges.

C. Modification

As designated by a phantom line shown in FIG. 6, if the edge reinforcing member 43 provided along the proximal side edge of the transfer belt 1 and another edge reinforcing member 43 provided along the distal side edge of the same are formed in the same size, the edge reinforcing members 43 can afford an even reinforcing strength to the proximal side edge and the distal side edge of the pressing members 40 and 41. This is considered to be optimum in the case where the sheet attracting area is defined in the center of the transfer belt 1 in a crosswise direction thereof.

Figure 8:
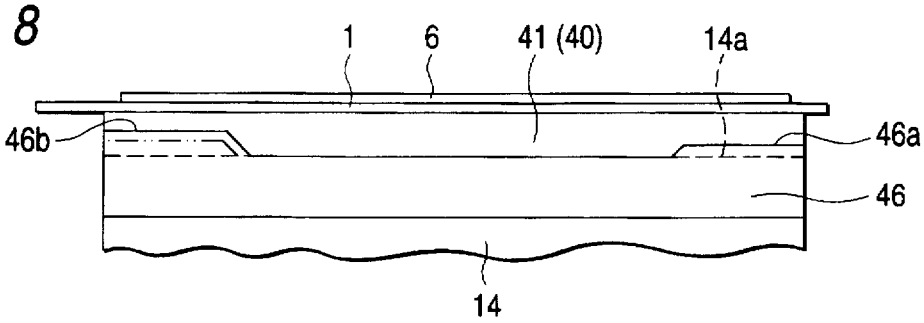
FIG. 8 is a front view of the principal elements of a modification of the embodiment.

FIG. 8 is a front view of the principal elements of the modification of the present embodiment. As illustrated in the drawing, a reinforcing member 46 is bonded to the upper surface of the pressing member 41. Edge reinforcing sections (edge reinforcing means) **46*a* and 46*b* protrude from both side edges of the reinforcing member 46 in a crosswise direction thereof, toward the transfer belt 1. The entire lower surface of the reinforcing member 46 is bonded to the overall upper surface of the pressing member 41. As a result, the pressing members 40 and 41 are less apt to deflect by and large. Compared with the pressing forces of the pressing members 40 and 41 in the case where the pressing members 40 and 41 are not provided with the reinforcing member 46, the pressing forces of the pressing members 40 and 41 are increased. As a result of the edge reinforcing members 46*a* and 46*b* being bonded to both side edges of the pressing member 41, the pressing forces of both sides of the pressing members 40 and 41 are increased so as to become greater than the pressing force of the center of the pressing members 40 and 41**.

In this way, the same effect as previously described can be obtained. Even in this modification, in order to provide the image forming apparatus with the belt hole 50 and the belt hole sensor 51, the sheet attracting area on the transfer belt 1 is deviated from the center of the transfer belt 1 in a crosswise direction thereof. Further, as in the previous embodiment, either the edge reinforcing section **46*a* or 46*b* (the edge reinforcing section 46*b* in the illustration) provided along the side edge of the transfer belt 1 that is apt to deflect under its own weight, is made large as designated by a phantom line, so that the pressing force is increased. However, if the sheet attracting area is set at the center of the transfer belt 1 in a crosswise direction thereof, the edge reinforcing sections 46***a* and 46*b* are formed in the same size. As a result, it becomes possible for the edge reinforcing sections 46*a* and 46*b* to afford an even reinforcing strength to the proximal side edge and the distal side edge of the pressing members 40 and 41.

Figure 9:
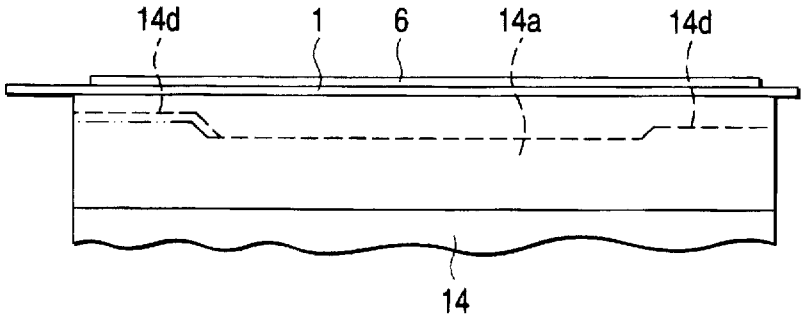
FIG. 9 is a front view of the principal elements of another modification of the embodiment.

FIG. 9 is a front view of an image forming apparatus according to still another modification of the first embodiment. The same effects as those obtained in the first embodiment are produced by means of the shape of the support 14*a* of the support 14 without the use of the reinforcing members. In short, each side edge of the leading edge of the support 14*a* has a protuberance, whereby the center of the leading edge of the support 14*a* has an indentation. As a result, edge reinforcing sections (edge reinforcing means) 14*d* are formed on both sides of the leading edge of the support 14*a*. As in the first embodiment, the edge reinforcing sections 14*d* may be formed in different sizes (as designated by a broken line) or in the same size (as designated by a phantom line).

(2) Second Embodiment

A. Configuration of an Image Forming Apparatus of a Second Embodiment

Figure 10:
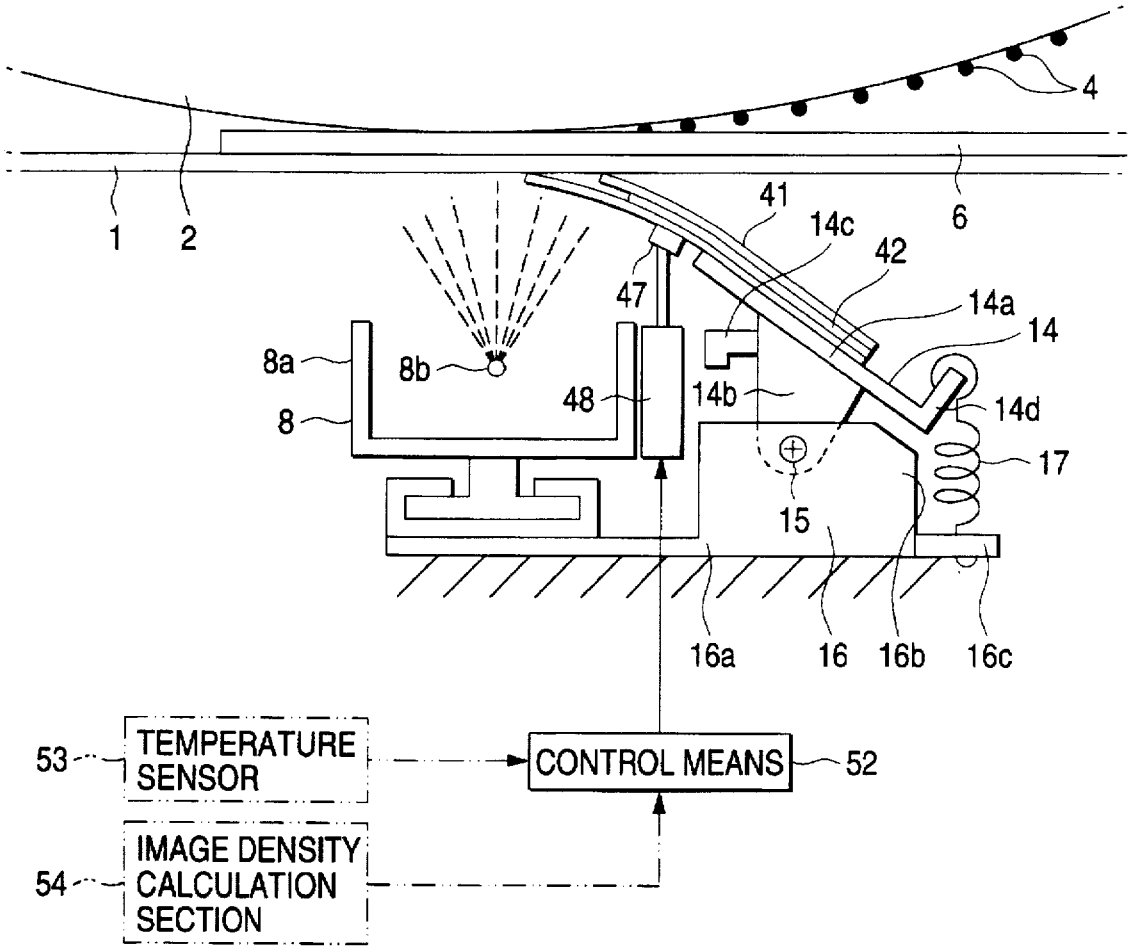
FIG. 10 is a side view of an image forming apparatus according to a second embodiment of the present invention.

FIG. 10 is a side view of an image forming apparatus according to a second embodiment of the present invention. In the present embodiment, Edge reinforcing members (edge reinforcing means) 47 are disposed below the pressing member 40; namely, they are disposed so as to be opposite to the transfer belt 1 with the pressing member 40 interposed between them. The edge reinforcing members 47 are actuated by a solenoid 48 so as to come into contact with or recede from the lower surface of the pressing member 40. Upon contact with the lower surface of the pressing member 40, the edge reinforcing members 47 reinforce the side edges of the pressing members 40 and 41 in a crosswise direction thereof. In contrast, on receding from the lower surface of the pressing member 50, the edge reinforcing members 47 terminate their reinforcing actions.

The operation of the solenoid 48 is controlled by control means 52.

B. Operation of the Image Forming Apparatus of the Second Embodiment

Where an image is formed only on one surface of the sheet 6, the control means 52 will not actuate the solenoid 48, and the edge reinforcing members 47 are kept away from the lower surface of the pressing member 41. In a double-sided image formation mode, the solenoid 48 is actuated before another image is formed after one image has been formed on one surface of the sheet 6. Then, the edge reinforcing members 47 are brought into contact with the lower surface of both side edges of the pressing member 40 in a crosswise direction thereof. As a result, both side edges of the pressing members 40 and 41 in a crosswise direction thereof are reinforced, and so the internal pressure of the nipping area formed between both side edges of the pressing members 40 and 41 and the corresponding edges of the transfer belt 1.

As a result of the above-described arrangement, the following effects will be produced. In most cases, both side edges of the sheet 6 in a crosswise direction thereof become crumpled up when the image is fixed by passing the sheet 6 through the fixing unit 30 after one image has been transferred to one surface of the sheet 6. Accordingly, the reinforcing strength exerted on the pressing members 40 and 41 from the edge reinforcing member 43 is not necessary when an image is formed on one surface of the sheet 6. In some cases, if the pressure exerted on both side edges within the nipping area is increased by the edge reinforcing members 47, the pressure exerted on the side edges will exceed a suitable range. This may bring about hollow characters.

In contrast, according to the second embodiment, the edge reinforcing members 47 do not carry out any reinforcing operation while an image is formed on one side of the sheet that is free from crumple in many cases. However, the edge reinforcing members 47 can perform an reinforcing operation while another image is formed on a second surface of the sheet that is crumpled up in many cases. As a result, it is possible to provide the sheet 6 with a suitable pressure distribution in respective cases. Therefore, the quality of pictures on both sides of the sheet can be improved.

(3) Third Embodiment

A. Configuration of the Image Forming Apparatus of the Third Embodiment

With reference to FIG. 10, an image forming apparatus according to a third embodiment of the present invention will be described. In FIG. 10, reference numeral 53 designates a temperature sensor (temperature sensing means). This temperature sensor 53 is brought into contact with the front surface of the heating roller 31 of the fixing unit 30 (see FIG. 1). The temperature of the surface of the heating roller 31 is detected, and a temperature signal corresponding to the thus-detected temperature is output.

In the third embodiment, the control means 52 compares the temperature signal with a predetermined value and makes the following determinations depending on the comparison results. In short, if the temperature signal is in excess of the predetermined value, the solenoid 48 is actuated such that the edge reinforcing members 47 afford a reinforcing strength to the pressing members 40 and 41. In contrast, if the temperature signal is under the predetermined value, the solenoid 48 will not be actuated so as to prevent the edge reinforcing members 47 from pressing the pressing member 40.

B. Effects of the Third Embodiment

Figure 11:
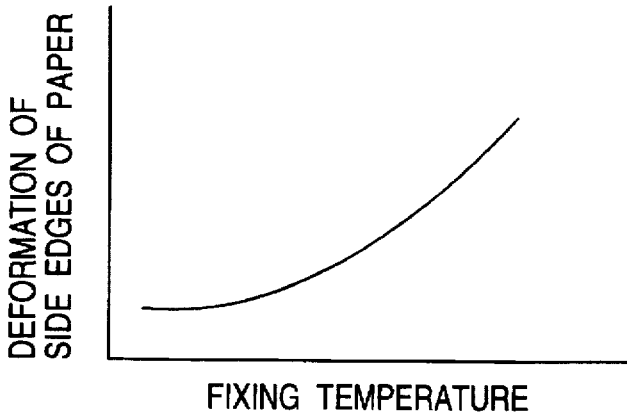
FIG. 11 is a plot showing the relationship between the temperature of a fixing unit of the image forming apparatus and the occurrence of crumples in side edges of copy paper in its crosswise direction.

FIG. 11 is a plot showing the relationship between the surface temperature of the heating roller 31 and the occurrence of deformations, such as crumples or waves, in the side edges of the sheet 6 (i.e., copy paper in the present embodiment) in a crosswise direction thereof. As shown in the drawing, the degree of deformation occurring in the side edges of the sheet 6 in a crosswise direction thereof increases as the surface temperature of the heating roller 31 increases. One of conceivable reasons for such an increase in the degree of deformation is that the profile of the nipping area formed between the heating roller 31 and the pressurizing roller 32 fails to have a desirable shape. Even if there are no temperature differences, the diameters of both sides of the rollers 31 and 32 are often set so as to become slightly larger than the diameter of the center of them in order to prevent the side edges of the sheet 6 from becoming crumpled up when it undergoes ordinary heating operations. If the heat temperature is increased more than the ordinary heat temperature, the amount of heat expansion of the rollers 31 and 32 fails to reach an appropriate amount, which in turn makes it difficult for the nipping area to have a desired profile. This is also deemed to be attributable to the increase in the degree of deformation.

Figure 12:
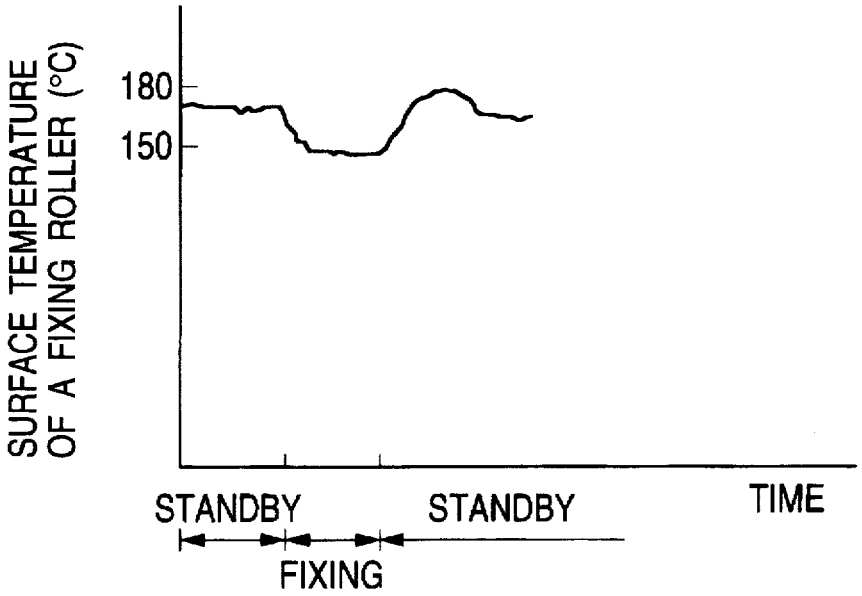

FIG. 12 is a plot showing variations in the surface temperature of the heating roller 31 with lapse of time after the power switch of the image forming apparatus has been turned on. As shown in the plot, the temperature of the heating roller 31 is about 170 degrees centigrade when the image forming apparatus is in a fixing standby condition. After the initiation of a fixing operation, the sheet 6 or the pressuring roller 32 that rotates so as to follow the heating roller 31 abruptly takes heat away from the heating roller 31, so that the surface of the heating roller 31 sharply falls. To compensate for the thus-deprived heat, a built-in lamp of the heating roller 31 is controlled so as to increase the amount of heat at the time of a fixing operation. Consequently, the heating roller 31 is controlled so as to prevent its surface temperature from falling under a temperature of 150 degrees centigrade. The generation of heat of the built-in lamp is reduced after the completion of the fixing operation. However, because of a delay in the transmission of heat within the heating roller 31, the surface temperature of the heating roller 31 continues rising in excess of a temperature of 180 degrees centigrade during a short period of time even after the image forming apparatus has entered the standby condition again. If the fixing temperature exceeds 180 degrees centigrade, the sheet 6 such as copy paper will become usually crumpled up considerably. In contrast, the sheet 6 of the same type will not become crumpled up under a certain temperature.

In this way, there is a close relationship between the occurrence of crumples in both side edges of the sheet 6 in a crosswise direction thereof and the temperature of the heating roller 31. If it is predicted, from the result of detection of the temperature of the heating roller 31, that the sheet 6 will become crumpled up, both side edges of the pressing members 40 and 41 will be reinforced by means of the edge reinforcing members 47. In contrast, if it is predicted that the sheet 6 will not become crumpled up, it is desirable to prevent the edge reinforcing members 47 from reinforcing the side edges of the pressing members 40 and 41. As a result, it becomes possible to afford a suitable pressure distribution to the sheet 6 corresponding to the crumples, which in turn enables appropriate control of the quality of the image formed on a second surface of the sheet 6.

(4) Fourth Embodiment

A. Configuration of an Image Forming Apparatus of the Fourth Embodiment

With reference to FIG. 10, an image forming apparatus according to a fourth embodiment of the present invention will now be described. In FIG. 10, reference numeral 54 designates an image density calculation section (image density calculating means). This image density calculation section 54 calculates the density of an image to be formed on the sheet 6 during the course of conversion of an input signal of an original image (where the image forming apparatus is a copier or a facsimile) or an input signal of a print image (where the image forming apparatus is a printer) when latent images are formed on the respective photosensitive drums 2Y, 2M, 2C, and 2K. The control means 52 receives an image density signal from the image density calculation section 54.

In the fourth embodiment, the control means 52 compares the density of an image with a predetermined value and makes the following determinations depending on the comparison results. In short, if the density of the image is under the predetermined value, the solenoid 48 is actuated such that the edge reinforcing members 47 afford a reinforcing strength to the pressing members 40 and 41. In contrast, if the temperature signal is in excess of the predetermined value, the solenoid 48 will not be actuated so as to prevent the edge reinforcing members 47 from pressing the pressing member 40.

B. Effects of the Fourth Embodiment

Figure 13:
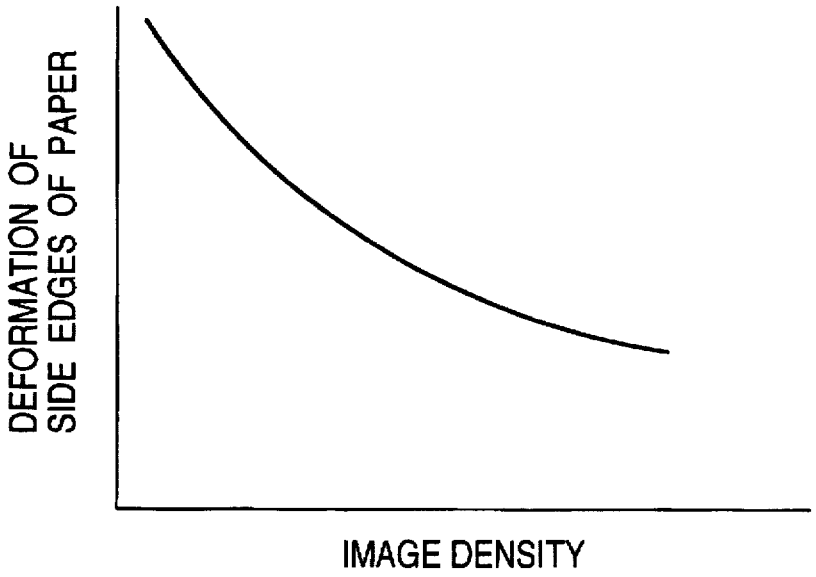
FIG. 13 is a plot that shows the relationship between the density of the image transferred on the copy paper and the occurrence of deformation in the side edges of the copy paper in its crosswise direction.

FIG. 13 is a plot showing the relationship between the density of an image to be transferred to the sheet (copy paper in the present embodiment) 6 and the occurrence of deformation of the side edges of the sheet 6 in a crosswise direction thereof. As shown in the plot, the degree of deformation occurring in the side edges of the sheet 6 in a crosswise direction thereof decreases as the density of the image increases. This is deemed to be attributable to the fact that the sheet 6 becomes easier to pass between the heating roller 31 and the pressurizing roller 32 by means of the toner forming the image as the density of the image increases. In short, the fused toner serves as a lubricant.

As described above, there is a close relationship between the occurrence of crumples in both side edges of the sheet 6 in a crosswise direction thereof and the density of the image formed on the sheet 6. If it is predicted, from the calculation of the density of an image to be formed, that the sheet 6 will become crumpled up, both side edges of the pressing members 40 and 41 will be reinforced by means of the edge reinforcing members 47. In contrast, if it is predicted that the sheet 6 will not become crumpled up, it is desirable to prevent the edge reinforcing members 47 from reinforcing the side edges of the pressing members 40 and 41. As a result, it becomes possible to afford a suitable pressure distribution to the sheet 6 corresponding to the crumples, which in turn enables appropriate control of the quality of the image formed on a second surface of the sheet 6.

It is also possible to predict crumples with higher accuracy by combination of the third and fourth embodiments. The edge reinforcing members 47 are arranged so as to afford the reinforcing strength to the pressing members 40 and 41 only when crumples are predicted.

(5) Fifth Embodiment

Figure 14:
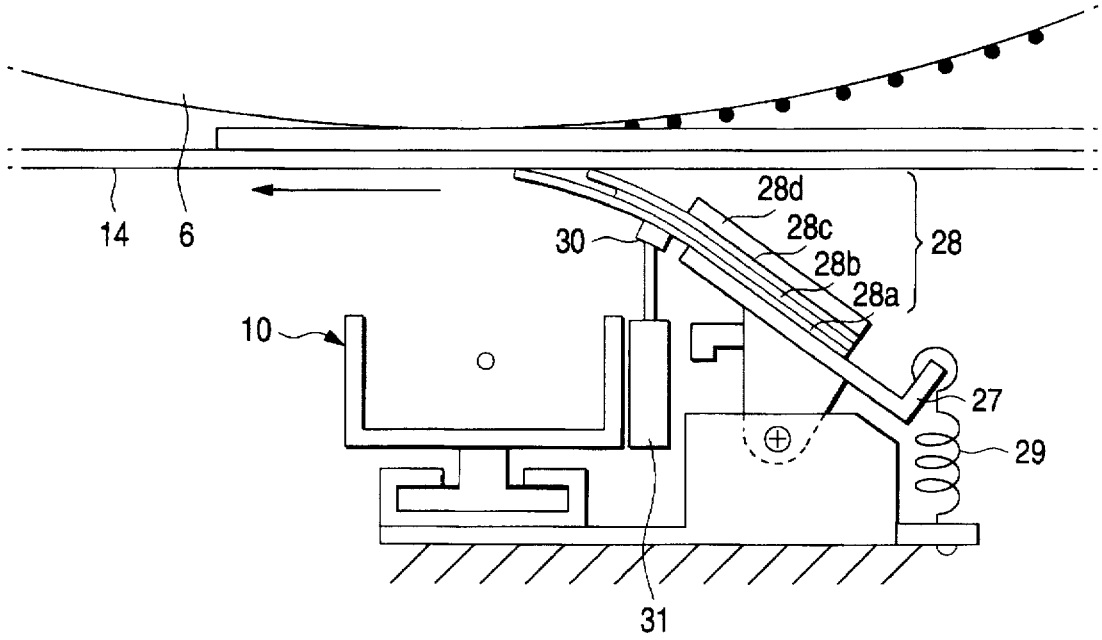
FIG. 14 is a perspective view of a transfer belt according to a fifth embodiment of the present invention.
Figure 15:
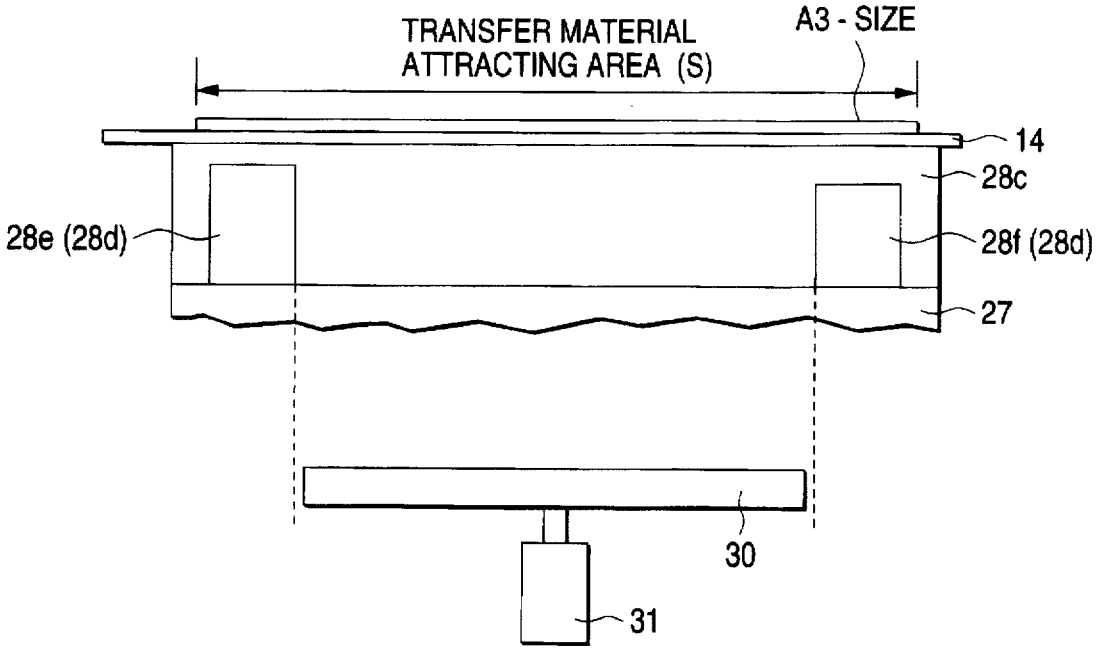
FIG. 15 is an enlarged view of each transfer position and its surrounding area according to the fifth embodiment of the present invention.
Figure 16:
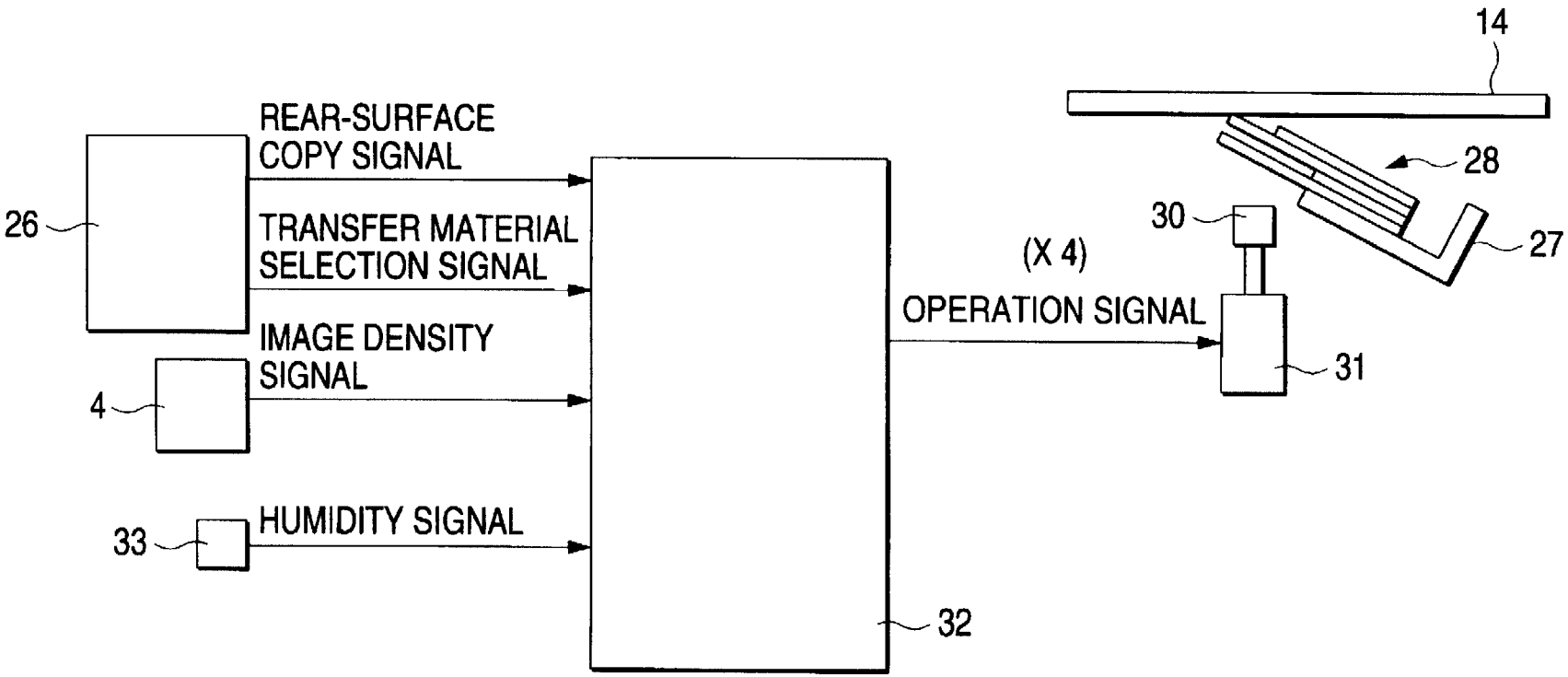
FIG. 16 is an explanatory illustration of a control system of a center pressing force reinforcing member of the fifth embodiment.

In a fifth embodiment, an image forming apparatus according to a fifth embodiment of the present invention is provided with four pressing means for pressing a transfer belt 14 against a photosensitive drum 6 in each transfer position; four center pressing force reinforcing members for reinforcing a pressing force of the center of the pressing means upon pressed contact with the respective pressing means; and center pressing force reinforcing member control means that controls the state in which the center pressing force reinforcing member 30 is pressed against the pressing means and brings each center pressing force reinforcing member 30 into pressed contact with each pressing means as necessary when an image is formed on the back of a transfer material, as shown in FIG. 14 through 16.

As shown in FIG. 14, the pressing means comprises a metal support member 27 that is rotatably disposed upstream of a transfer corotron 10 in the direction in which the transfer belt 14 travels; a pressing plate 28 that is fixed on the support member 27 so as to project about 10 mm toward the transfer corotron 10 with respect to the pivot of the support member 27; and a coil spring 29 for affording a force to the support member 27 in such a direction that the pressing plate 28 is pressed against the transfer belt 14. The pressing means presses the transfer belt 14 against the photosensitive drum 6 by the force corresponding to the elastic deformation of the coil spring 29 and the pressing plate 28.

The pressing plate 28 comprises a four-layer thin plate formed from polyethylene terephthalate. The respective thin plates will be hereinafter referred to as a first layer **28*a*, a second layer 28*b*, a third layer 28*c*, and a fourth layer 28*d* in order from the support member 27. The first layer 28*a* and the third layer 28*c* are made of a thin plate about 305 mm wide (i.e., having such a width that each side of the plate extends to about 10 mm from a transfer material attracting area S of the transfer belt 14), 188 μm thick, and 34 mm long, as shown in FIG. 15. The second layer 28***a* is made of a thin plate that is formed so as to have a thickness of 125 μm as well as the same width as the first thin plate 28*a*. The fourth layer 28*d* comprises two rectangular thin plates 28*e* and 28*f* which are disposed along both side edges of the thin plate for use as the third layer 28*c*. The rectangular thin plates 28*e* and 28*f* have a thickness of 250 μm and a width of 20 mm. They are disposed 5 mm in an inner direction from both edges of the thin plate for use as the third layer 28*c*. The rectangular thin plates 28*e* and 28*f* are different from each other in length. As a result, the contact force developed in between the transfer belt 14 and the photosensitive drum 6 becomes symmetrical about the transfer material attracting area on the transfer belt 14 in a crosswise direction thereof. The above-described thin plates are bonded together with the pressure sensitive adhesive double coated tape (#500 manufactured by Nitto Denko Co., Ltd.). The first to third layers 28*a* to 28*c* will be hereinafter simply referred to as a baffle, and the fourth layer 28*d* will be hereinafter referred to as an edge pressing force reinforcing member.

The center pressing force reinforcing member 30 is made by forming polyethylene terephthalate having a thickness of 188 μm so as to have a width of 100 mm. This center pressing force reinforcing member 30 presses the baffles 28*a* to 28*c* upward between the thin plates of the edge pressing force reinforcing member 28*d* (i.e., at the center of the baffles in a crosswise direction thereof).

The center pressing force reinforcing member control means comprise four electromagnetic solenoids 31 that retain the respective center pressing force reinforcing members 30 so as to come into contact with or recede from the baffles 28*a* to 28*c*; and a press timing control member 32 for controlling the operations of the four electromagnetic solenoids 31.

The press timing control member 32 receives a rear-surface image formation signal and a transfer material selection signal from a main control section 26, the image density signal from an image processing section 4, and detection signals from humidity sensors 33 disposed in proximity to transfer material container trays 5, 5, 5 that contain various types of transfer material, as shown in FIG. 16. The press timing control member 32 actuates the four electromagnetic solenoids 31 in response to these input information items.

Specifically, the press timing control member 32 is arranged so as to actuate the electromagnetic solenoids 31 at predetermined timing upon receipt of the rear-surface image formation signal in any one of the following cases: namely, where the transfer material container tray 5 containing ordinary paper is selected; where the humidity is more than 65% (this humidity corresponds to the case where paper has a moisture content of more than 5.6%); and where the density of the image formed on the surface of the transfer material extends over the entire transfer material, as well as an average concentration of the image being in excess of 30% (hereinafter referred to as an area coverage of more than 30%). The above-described predetermined timing differs according to the length of the transfer material in the direction in which it is fed. The timing is set such that the center pressing force reinforcing member 30 presses the baffles 28*a* to 28*c* at the position of the transfer material 50 mm spaced apart from its rear edge at all times regardless of the type of transfer material.

Where an image having an area coverage of more than 30% is formed on thin paper at a humidity of more than 65%, the electromagnetic solenoids 31 are arranged so as to actuate before the transfer material is transported to the transfer position when the press timing control member 32 receives the rear-surface image formation signal. As a result, the center pressing force reinforcing member 30 continues pressing the baffles 28*a* to 28*c* against all over the transfer material.

Figure 17:
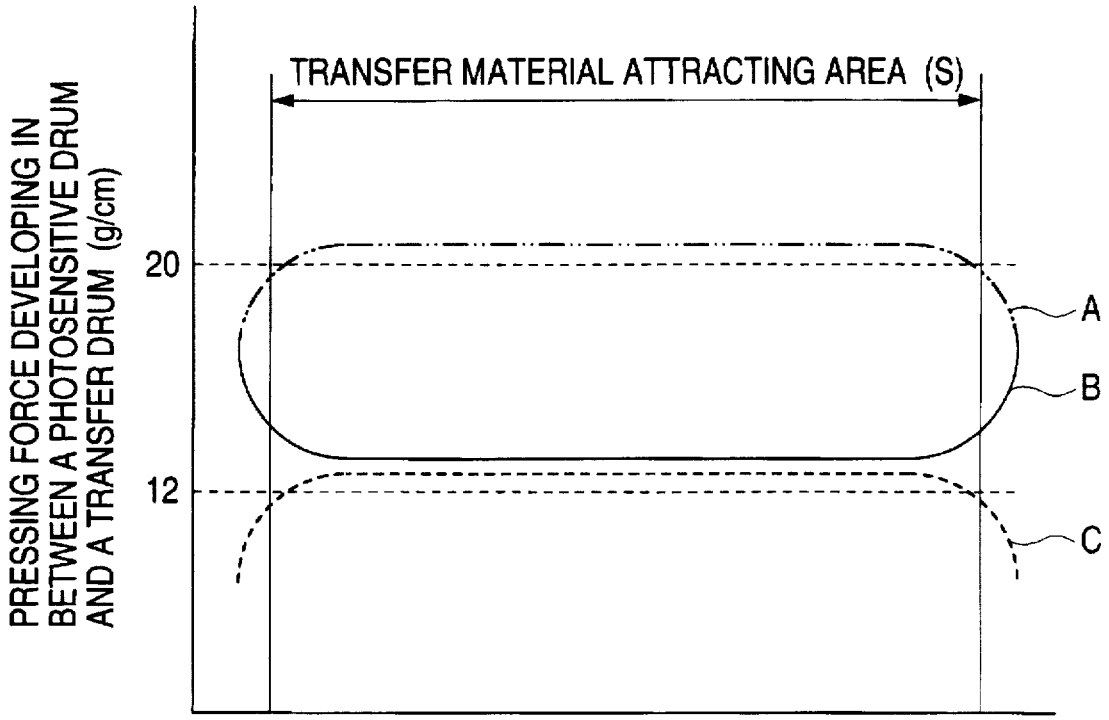
FIG. 17 is a diagrammatic representation of the distribution of a contact force developed in between the transfer belt and a photosensitive drum (in a crosswise direction of the transfer belt)

FIG. 17 shows the distribution of contact force arising in between the transfer belt 14 and the photosensitive drum 6 in a crosswise direction of the transfer belt 14. In the drawing, A designates the distribution of the contact force produced in the case where the center pressing force reinforcing member 30 presses the baffles 28*a* to 28*c* against the transfer belt 14. The contact force is more intensive at the center than at both side edges of the transfer belt 14. The maximum value of the contact force is more than 20 g/cm. In the drawing, B designates the distribution of the contact force produced in the case where the center pressing force reinforcing member 30 is spaced apart from the baffles 28*a* to 28*c*. In this case, the contact force is more intensive at both side edges than at the center of the transfer belt 14. The minimum value of the contact force is more than 12 g/cm.

The above-described contact force is obtained by measuring the force that a columnar metal pressure measuring jig having the same radius as the photosensitive drum receives in the direction orthogonal to the transfer belt when that pressure measuring jig instead of the photosensitive drum is brought into pressed contact with the transfer belt at the transfer position.

The formation of a full-color image on each surface of the transfer material was tested using the image forming apparatus of the present embodiment.

Consequently, imperfections in picture quality due to the partial omission of a transferred image did not occur, regardless of an image density or humidities, in any one of the cases as shown in table 1; namely, where thick paper having a weighing capacity of more than 100 g.s.m. is used as the transfer material; where paper having a weighing capacity of 82 g.s.m. (i.e., the standard paper of this image forming apparatus) is used as the transfer material; and where thin paper having a weighing capacity of 56 g.s.m. is used as the transfer material. The weighing capacity of 56 g.s.m. is substantially equivalent to the weighing capacity of two sheets of tracing paper.

A similar test (a comparative test) was carried out while the center pressing force reinforcing member 30 was prohibited. The image formed on the back of the transfer material was partially omitted so as to correspond to waves of the transfer material in any one of the cases shown in table 1; namely, where thin paper having a weighing capacity of 56 g.s.m. is used as the transfer material; where paper having a weighing capacity of 82 g.s.m. (the standard paper of this image forming apparatus) is used as the transfer material at a humidity of more than 65%; and where an image having an image density, that is, an area coverage of more than 30% is formed on paper that has a weighing capacity of 82 g.s.m. (the standard paper of this image forming apparatus).

Comparison 1

An image forming apparatus is the same as the image forming apparatus of the first embodiment, except that the pressing plate 28 is made up of only the baffles 28*a* to 28*c*, and that the center pressing force reinforcing member 30 and the center pressing force reinforcing member control means are removed from the image forming apparatus. With this configuration, the contact force arising in between the transfer belt 14 and the photosensitive drum 6 takes such a distribution as designated by C in FIG. 17.

As a result of the test that is the same as the fifth embodiment, the image formed on the back of the transfer material was partially omitted so as to correspond to the waves of the transfer material regardless of the image density and humidities as shown in table 1, except for the case where thick paper having a weighing capacity of more than 100 g.s.m. is used as the transfer material.

TABLE 1

| | THICK PAPER (MORE THAN 100 g.s.m.) | STANDARD PAPER (82 g.s.m.) | THIN PAPER (56 g.s.m.) |
|---|---|---|---|
| Embodiment 1 | ○ | ○ | ○ |
| Comparative Test | ○ | Δ | X |
| Comparison 1 | ○ | X | x |

(6) Other Modifications

The present invention is not limited to the above-described embodiments and can be modified in various ways as described below:

[1] Although the previous embodiments are provided with the two pressing members 40, 41, either of the pressing members may be omitted.

[2] The present invention can be applied to a monochrome image forming apparatus having only one photosensitive drum instead of the color image forming apparatus as described above.

[3] The edge reinforcing members 47 are completely separated from the pressing member 40 when both side edges of the pressing members do not need to be reinforced in the second through fourth embodiments. Depending on conditions such as the size and material of the pressing members 40, 41, the reinforcing strength of the edge reinforcing members 47 may be reduced in place of the complete separation of the edge reinforcing member 47 from the pressing member 40.

[4] The means for actuating the edge reinforcing members 47 used in the image forming apparatuses of the second through fourth embodiments may be implemented by a link mechanism or a cam mechanism in lieu of the electromagnetic solenoid 48. Alternatively, for instance, the means may be arranged such that the pressing members 40, 41 are brought into contact with and separated from the transfer belt i by pivoting the support 14 around the shaft 15. In this event, the edge reinforcing members 47 may be also actuated by use of means for pivoting the support 14.

[5] Where the image forming apparatuses of the second through fourth embodiments are provided with the belt hole 50 and the belt hole sensor 51 that are the same as those used in the first embodiment, and where the area for attracting the sheet 6 is deviated from the longitudinal center of the transfer belt 1, the two edge reinforcing members 47 will be formed in different sizes. As a result, it becomes possible to apply different reinforcing strengths to the proximal and distal side edges of the transfer belt 1. Further, it is possible to make the reinforcing strengths of the two edge reinforcing members 47 different from each other by controlling the force of the drive means such as the electromagnetic solenoid 48.

[6] The image forming apparatuses of the previous embodiments are designed such that the transfer belt 1 attracts the sheet 6, and that the toner images are transferred to the sheet 6 from the photosensitive drums 2Y, 2M, 2C, and 2K. However, the present invention may be also applied to the modification shown in FIG. 18.

Figure 18:
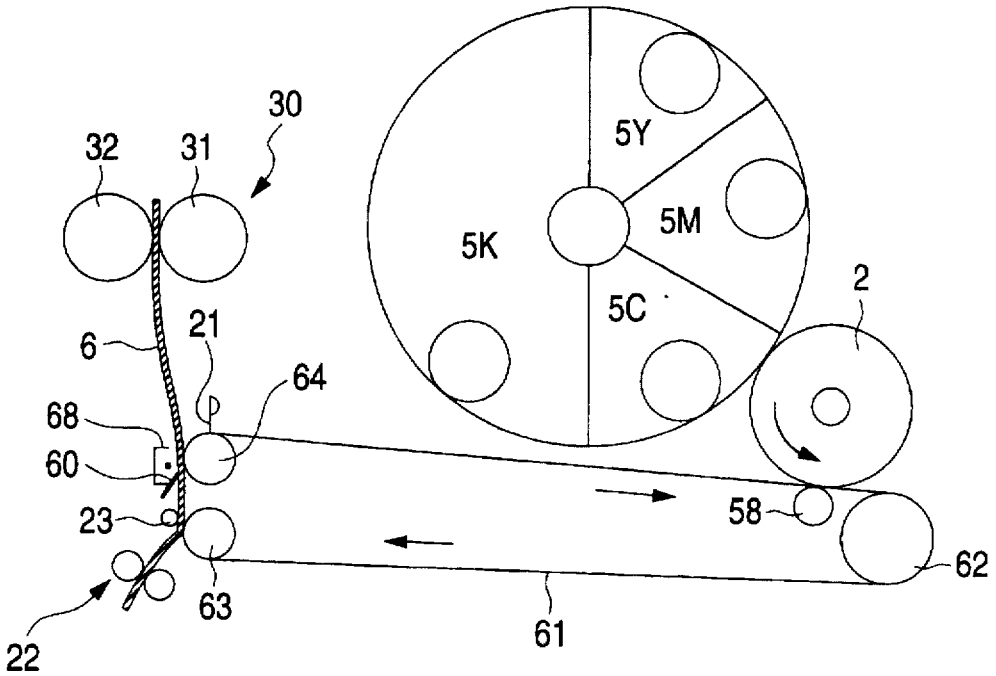
FIG. 18 is a schematic representation of still another modification of the embodiment of the present invention.

In FIG. 18, reference numeral 61 designates an intermediate transfer belt (an endless belt), and this intermediate transfer belt 61 is wrapped around rollers 62, 63, and 64. The transfer belt 61 travels around these rollers in the direction designated by an arrow. The photosensitive drum 2 is disposed on the surface of the intermediate transfer belt 61, and toner images having a plurality of colors are formed on the photosensitive drum 2 by the developing units 5Y, 5M, 5C, and 5K. The toner images on the photosensitive drum 2 are transferred to the intermediate transfer belt 61 by means of a primary transfer roller 58 to which a bias voltage is applied. Color toner images are formed through the repetition of the above-described operations.

A secondary transfer corotron 68 to which a bias voltage is applied is disposed so as to be opposite to the roller 64 with the intermediate transfer belt 61 sandwiched between them. The color toner images formed on the intermediate transfer belt 61 are further transferred to the sheet 6 by means of an secondary electric field generated by the secondary transfer corotron 68. A pressing member (pressing means) 60 is disposed in the vicinity of and upstream of the secondary transfer corotron 68 in the direction in which the sheet 6 is transported. The pressing member 60 is arranged so as to press the sheet 6 against the intermediate transfer belt 61. The same reference numerals as those used in the previous embodiments are assigned to designate the other elements of this modified embodiment, and their explanations will be omitted.

Even in this modification of the embodiment, the image forming apparatus may be provided with such edge reinforcing means as those used in the previous embodiments in order to press both side edges of the pressing member 60. This modification also produces the effect of removing the crumples of both side edges of the sheet 6 that are generated as a result of the transfer of an image on the second surface of the sheet after the sheet having passed through the fixing unit 30.

As described above, by virtue of the image forming apparatus as defined in claim 1 of the present invention, it is possible to appropriately bring crumpled-up side edges of a sheet into pressed contact with the rotating members by means of the pressing means. As a result, the quality of a resultant image can be improved.

By virtue of the image forming apparatus as defined in claim 2 of the present invention, even in the case where the area of an endless belt that faces the sheet is deviated from the center of the endless belt in a crosswise direction thereof as a result of the layout of parts or for any reasons, a pressing force exerted on the sheet can be appropriately distributed.

By virtue of the image forming apparatus as defined in claim 3 of the present invention, it is possible to render the edge reinforcing means in a substantially inactive state during the course of formation of an image on a first surface of the sheet that is free from crumples in many cases. However, during the course of the formation of an image on a second surface of the sheet that is crumpled up in many cases, the edge reinforcing means can be activated. In consequence, an appropriate pressing force distribution can be exerted on the sheet in each case. Therefore, the quality of the images formed on both surfaces of the sheet can be improved.

By virtue of the image forming apparatuses as defined in claims 4 and 5, it is possible to forecast whether or not the sheet becomes crumpled up as a result of the formation of an image on the first surface of the sheet. If crumples are expected, it is possible to substantially activate the edge reinforcing means when an image is formed on a second surface of the sheet. Consequently, it is possible to provide the sheet with an appropriate pressing force distribution corresponding to the crumples, and the quality of the image formed on the second surface of the sheet can be appropriately controlled.

By virtue of the image forming apparatuses as defined in claims 6 through 12 of the present invention, the pressing means are formed such that the pressing forces exerted on both edges of the transfer belt in the crosswise direction thereof become greater than the pressing force exerted on the center of the transfer belt in the same direction, and that the pressing means are also provided with the center pressing force reinforcing member for reinforcing the pressing force of the center of the pressing means in the crosswise direction thereof when the pressing means are pressed against the pressing means, and the center pressing force reinforcing member control means for controlling the state in which the center pressing force reinforcing member is pressed against the pressing means as well as for pressing the center pressing force reinforcing member against the pressing means as necessary when an image is formed on the back of the transfer material. -The state in which the center pressing force reinforcing member is pressed against the pressing means can be switched depending on the type of transfer material, as required. As a result, imperfections in picture quality due to the partial omission of an image are prevented even when images are formed on both sides of the transfer material of various types.

What is claimed is:

1. An image forming apparatus comprising:

an endless belt that is wrapped around and so transported by a plurality of rollers;

rotating members which are disposed adjacent to said endless belt such that an image is transferred onto a sheet while the sheet passes between said rotating members and said endless belt;

pressing means that are disposed in a crosswise direction of said endless belt so as to be opposite to said rotating members with respect to said endless belt and press said endless belt against said rotating member in the vicinity of the position where said endless belt is in close proximity to said rotating member; and edge reinforcing means for increasing pressing forces of said pressing means that act on both edges of said-endless belt in the crosswise direction thereof so as to become greater than a pressing force of said pressing means that acts on the center of said endless belt in the same direction.

2. The image forming apparatus of claim 1, wherein the area of said endless belt that faces the sheet is displaced from the center of said endless belt in the crosswise direction thereof, and said edge reinforcing means increases the pressing force of said pressing means disposed in the area of a larger interval between the side edge of said endless belt and the side edge of the area than that of said pressing means disposed in the area of a smaller interval between the side edge of said endless belt and the side edge of the area.

3. The image forming apparatus of claim 1, further comprising:

control means for increasing the reinforcing strength applied from said edge reinforcing means to said pressing means before another image is formed after one image has been formed on one surface of the sheet, wherein an image is formed on each side of one sheet by passing the sheet between said endless belt and said rotating members twice, and said edge reinforcing means is arranged so as to be able to change a reinforcing strength applied to said pressing means.

4. The image forming apparatus of claim 3, further comprising:

fixing means for fixing the image transferred to the sheet by heating and pressurizing the sheet; and temperature detecting means for detecting the temperature of said fixing means, wherein said control means determines whether or not the reinforcing strength applied from said edge reinforcing means to said pressing means is increased, from the result of the detection carried out by said temperature detecting means.

5. The image forming apparatus of claim 3, further comprising:

image density measuring means for measuring the density of the image transferred to the sheet, wherein said control means determines whether or not said reinforcing means applied to said pressing means from said edge reinforcing means is increased, from the result of the measurement carried out by said image density measuring means.

6. An image forming apparatus comprising:

a toner image carrier that carries a toner image, transfer means that is disposed so as to be opposite to the toner image carrier and forms an electric field for transfer purposes between the transfer means and the toner image carrier, a transfer belt that is rotatable so as to pass between the toner image carrier and the transfer means and attracts a transfer material, pressing means that are disposed upstream of the transfer means in the direction of rotation of the transfer belt and press the transfer belt against the toner image carrier, said pressing means further comprising:

a center pressing force reinforcing member for reinforcing the pressing force of the center of the pressing means in the crosswise direction thereof when the pressing means are pressed against the pressing means, and center pressing force reinforcing member control means for controlling the state in which said center pressing force reinforcing member is pressed against said pressing means as well as for pressing said center pressing force reinforcing member against said pressing means as necessary when an image is formed on the back of the transfer material, fixing means that is disposed downstream of the transfer belt in the direction of a transport path of the transfer material and heats and/or pressurizes the transfer material peeled from the transfer belt, wherein the toner image is transferred to the transfer material while the transfer material is attracted to said transfer belt, and an image is formed on the transfer material by heating and/or pressuring the transfer material using said fixing means, said image forming apparatus being also capable of forming an image on each surface of the transfer material by repetitively carrying out the above-described processes, and wherein said pressing means are formed such that the pressing forces exerted on both edges of the transfer belt in the crosswise direction thereof become greater than the pressing force exerted on the center of the transfer belt in the same direction.

7. The image forming apparatus of claim 6, wherein said center pressing force reinforcing member control means presses said center pressing force reinforcing member against said pressing means depending on the type of transfer material.

8. The image forming apparatus of claim 6, wherein said center pressing force reinforcing member control means presses said center pressing force reinforcing member against said pressing means depending on the moisture content of transfer material.

9. The image forming apparatus of claim 8, further comprising:

an internal environment measuring member for measuring the environment of the inside of said image forming apparatus, wherein said center pressing force reinforcing member control means estimates the moisture content of the transfer material from the result of a measurement carried out by said internal environment measuring member, and presses said center pressing force reinforcing member against said pressing means depending on the result of the estimation.

10. The image forming apparatus of claim 6, wherein said center pressing force reinforcing member control means presses said center pressing force reinforcing member against said pressing means depending on the density of an image formed on the front surface of the transfer material.

11. The image forming apparatus of claim 6, wherein said center pressing force reinforcing member control means constantly presses said center pressing force reinforcing member against said pressing means for the time period during which an image is transferred to the back of the transfer material.

12. The image forming apparatus of claim 6, wherein said center pressing force reinforcing member control means constantly presses said center pressing force reinforcing member against said pressing means only for the time period during which an image is transferred to the rear edge of the back of the transfer material.

* * * * *